US005896295A

United States Patent [19]

Matsushita et al.

[11] Patent Number: 5,896,295

[45] Date of Patent: Apr. 20, 1999

[54] EMBROIDERING APPARATUS AND METHOD

[75] Inventors: Narihiro Matsushita, Waltham; Michael G. Dunlap, Billerica, both of Mass.

[73] Assignee: Brother Kogyo Kabushiki Kaisha, Nagoya, Japan

[21] Appl. No.: 08/711,594

[22] Filed: Sep. 10, 1996

[51] Int. Cl.[6] ..... D05C 7/66; D06F 19/00; G06G 7/66

[52] U.S. Cl. ..... 364/470.09; 364/470.06; 112/102.05; 112/470.07

[58] Field of Search ..... 364/470.09, 470.06, 364/470.08; 112/102.05, 121.12, 470.07, 470.02, 475.19; 227/109

[56] References Cited

U.S. PATENT DOCUMENTS

| | | | |
|---|---|---|---|
| 4,369,722 | 1/1983 | Nishida et al. | 112/103 |
| 4,622,907 | 11/1986 | Kimura | 112/102.05 |
| 4,730,566 | 3/1988 | Brophy et al. | 112/470.07 |
| 5,228,402 | 7/1993 | Sugimoto | 112/121.12 |
| 5,283,748 | 2/1994 | Muramatsu | 364/470.09 |
| 5,299,514 | 4/1994 | Hayakawa et al. | 112/470.09 |
| 5,311,439 | 5/1994 | Hayakawa et al. | 364/470.09 |
| 5,359,949 | 11/1994 | Asano | 112/470.02 |
| 5,499,589 | 3/1996 | Kyuno et al. | 112/102.5 |
| 5,537,945 | 7/1996 | Sugihara et al. | 227/109 |
| 5,592,891 | 1/1997 | Muto | 112/475.19 |

*Primary Examiner*—Reba I Elmore
*Assistant Examiner*—McDieunel Marc
*Attorney, Agent, or Firm*—Oliff & Berridge, PLC

[57] ABSTRACT

An embroidering data processing apparatus including a memory for storing embroidering data which are formulated to embroider an embroidery pattern and which include pattern embroidering data including component data sets for embroidering respective components of the embroidery pattern, each component consisting of at least one element each of which is continuously embroidered by the same thread. The component data sets are stored in the memory in a predetermined storing order. The apparatus further includes a sewing order determining device for determining a sewing order in which all of the elements included in the embroidery pattern are sequentially embroidered. The sewing order determining device is adapted to determine the sewing order so as to satisfy a predetermined condition or conditions and such that the number of changes of threads required for embroidering the elements according to the sewing order numbers is smaller than that required for embroidering the elements of the components in the predetermined storing order.

26 Claims, 12 Drawing Sheets

FIG. 9

INITIALIZED DATA (INITIAL STATES OF DATA)

COMPONENT 1

ELEMENT 1
COLOR CODE $C_{11}$: 001
ORDER NUMBER CODE $R_{11}$: 0
ELEMENT 2
COLOR CODE $C_{12}$: 002
ORDER NUMBER CODE $R_{12}$: 0
NUMBER $E_1$ OF ELEMENTS: 2
NUMBER $P_1$ OF ORDER-DETERMINED ELEMENTS: 0

COMPONENT 2

ELEMENT 1
COLOR CODE $C_{21}$: 002
ORDER NUMBER CODE $R_{21}$: 0
ELEMENT 2
COLOR CODE $C_{22}$: 001
ORDER NUMBER CODE $R_{22}$: 0
NUMBER $E_2$ OF ELEMENTS: 2
NUMBER $P_2$ OF ORDER-DETERMINED ELEMENTS: 0

COMPONENT 3

ELEMENT 1
COLOR CODE $C_{31}$: 001
ORDER NUMBER CODE $R_{31}$: 0
ELEMENT 2
COLOR CODE $C_{32}$: 002
ORDER NUMBER CODE $R_{32}$: 0
NUMBER $E_3$ OF ELEMENTS: 2
NUMBER $P_3$ OF ORDER-DETERMINED ELEMENTS: 0

TOTAL COMPONENT NUMBER $S_C$: 3
TOTAL ELEMENT NUMBER $S_E$: 6

M: 1 (COMPONENT NUMBER)
N: 1 (ELEMENT NUMBER)
Q: 1 (SEWING ORDER NUMBER)

DIRECTION CODE DIR: 0 (FORWARD)
CODE DIR INDICATIVE OF FORWARD OR BACKWARD DIRECTION ~~OF~~ MATCHING CHECK

FORWARD: DIRECTION IN WHICH THE COMPONENTS ARE ARRANGED

BACKWARD: DIRECTION OPPOSITE TO THE FORWARD DIRECTION

CURRENTLY EFFECTIVE COLOR CODE C: $C_{11}$

COLOR CHANGING FLAG F: 0 (OFF)

FIG. 11

| | | COLOR CODE |
|---|---|---|
| START DATA | | |
| ELEMENT 102 STITCH POSITION DATA | 1X – ELEMENT 102 | 001 |
| FEED DATA | | |
| ELEMENT 104 STITCH POSITION DATA | 2Z – ELEMENT 104 | 001 |
| COLOR CHANGE COMMAND DATA | | |
| ELEMENT 108 STITCH POSITION DATA | 3Z – ELEMENT 108 | 002 |
| FEED DATA | | |
| ELEMENT 110 STITCH POSITION DATA | 4Y – ELEMENT 110 | 002 |
| FEED DATA | | |
| ELEMENT 106 STITCH POSITION DATA | 5X – ELEMENT 106 | 002 |
| COLOR CHANGE COMMAND DATA | | |
| FEED DATA | | |
| ELEMENT 112 STITCH POSITION DATA | 6Y – ELEMENT 112 | 001 |
| END DATA | | |

EMBROIDERING APPARATUS AND METHOD

BACKGROUND OF THE INVENTION

1. Field of the Invention

The present invention relates to an apparatus and a method for processing embroidering data, a recording medium storing an embroidering data processing program, a recording medium storing embroidering data obtained according to the embroidering data processing program, and an embroidery sewing machine adapted to perform an embroidery sewing operation according to the embroidering data.

2. Discussion of the Related Art

There is known an embroidering data processing apparatus including (a) embroidering data memory for storing a batch of embroidering data for embroidering an embroidery pattern, such that a plurality of component data sets representative of respective components of the embroidery pattern are stored in a predetermined storing order, each component of the embroidery pattern consisting of at least one element which is continuously embroidered with a same thread, and (b) a sewing order determining device for determining a sewing order in which all of the elements included in the embroidery pattern consisting of the plurality of component data sets are embroidered.

As indicated above, an embroidery pattern to be formed by an embroidery sewing operation consists of a plurality of components, each of which consists of one or more elements. The embroidery pattern is embroidered according to a batch of pattern embroidering data which include a plurality of component data sets for embroidering the individual components of the embroidery pattern, respectively. Each component data set consists of at least one element data set, each of which represents an element of the component. The term "element" is defined as an elemental embroidery area that can be continuously embroidered using the same thread. The elemental embroidery area may be either a single enclosed area, or alternatively two or more enclosed areas which are continuously embroidered with the same thread such that the embroidered separate enclosed areas are connected with a jumping or bridging stitch or stitches.

In the embroidering data memory provided in the embroidering data processing apparatus, the component data sets are stored in the predetermined storing order. In principle, this order is an order in which the component data sets are entered or selected by an operator of an embroidery sewing machine. However, the order in which the component data sets are stored in the memory may be changed by editing. An embroidery sewing machine equipped with this known embroidering data processing apparatus is operated according to an embroidering control program which is formulated such that the components of the embroidery pattern are embroidered in the above-indicated storing order, in which the component data sets are stored in the memory, and such that the elements of each component are embroidered in an order in which the element data sets are stored in the memory. It is generally desirable that the components of the embroidery pattern be embroidered in the order in which the components are arranged in the embroidered pattern. Usually, therefore, the operator manipulates the processing apparatus so that the component data sets are eventually stored in the memory in the order in which the components are arranged in the embroidery pattern.

Referring to FIG. 13, there is shown an example of an embroidery pattern 300 consisting of three components in the form of hemmed characters "x", "y" and "z", each consisting of a core element 302, 306, 310 embroidered by a red thread, and an outer hemming element 304, 308, 312 subsequently embroidered by a blue thread. In the embroidering data memory, component data sets representative of the components "x", "y" and "z" are stored in this order of description. Each of element data sets representative of the respective elements 302, 304, 306, 308, 310, 312 of each component "x", "y" and "z" includes stitching data, and thread designating data indicative of the kind (color) of thread used for embroidering the element in question. The element data sets of each component data set are stored in an order in which the elements are embroidered or sewn.

For instance, the component data set for embroidering the component "x" includes stitching data representative of the core element 302, thread designating data indicative of the red thread used for this core element 302, stitching data representative of the hemming element 304, and thread designating data indicative of the blue thread used for this hemming element 304. The element data sets for the elements 302, 304 are stored in this order so that the core element 302 is first sewn and the hemming element 304 is then sewn. Similarly, the component data sets for embroidering the components "y" and "z" include element data sets for the elements 306, 308, or element data sets for the elements 310, 312. The element data set for the core element 306, 310 to be embroidered by the red thread, and the element data set for the hemming element 308, 312 to be embroidered by the blue thread are stored in this order. Therefore, the elements 302, 304, 306, 308, 310 and 312 are embroidered in this order of description, and the color of the thread designated by the thread designating data changes in the order of "red", "blue", "red", "blue", "red" and "blue". When the embroidery pattern 300 of FIG. 13 is embroidered according to the pattern embroidering data formulated as described above, the embroidery sewing operation requires the thread to be changed five times.

Referring next to FIG. 6, there are shown elements 102, 104, 106, 108, 110, 112 of an embroidery pattern 100 which are embroidered in the order which will be described.

Like the component data sets of the embroidery pattern 300 described above, component data sets for embroidering components "x", "y" and "z" of the present embroidery pattern 100 are stored in the order of description. For the components "x" and "z", the elements 102, 104 to be embroidered by a red thread are embroidered before the elements 106, 108 to be embroidered by a blue thread. For the component "y", however, the element 110 to be embroidered by the blue thread is embroidered before the element 112 embroidered by the red thread. Therefore, the elements of the embroidery pattern 100 are embroidered in the order of 102, 106, 110, 112, 104 and 108, and the color of the thread designated by the thread designating data changes in the order of "red", "blue", "blue", "red", "red" and "blue". In this case, the embroidery sewing operation to form the embroidery pattern 100 of FIG. 6 requires the thread to be changed three times.

To change the thread, an embroidery sewing machine is stopped to cut the thread and position a needle bar support device and the related components to bring the needle bar corresponding to the new thread into position. The procedure to change the thread is time-consuming. Described in detail, the needle bar support device carries a plurality of needle bars to which respective needles are attached. When the thread is changed from one to another, the needle bar having the needle through which the thread to be used next is inserted should be brought to the operating position by moving the needle bar support device. The efficiency of the embroidery sewing machine is lowered with an increase in the required number of changes of the threads.

In view of the above drawback, there is proposed an embroidering data processing apparatus equipped with a sewing order determining device for determining the sewing order such that all elements of an embroidery pattern that are embroidered by the same thread are sewn continuously. In the embroidery sewing machine with this sewing order determining device of "continuous same-thread embroidering type", the core elements 302, 306, 310 of the embroidery pattern 300 of FIG. 13 are continuously embroidered with the red thread, and then the hemming elements 304, 308, 312 are continuously embroidered with the blue thread. In this case, the embroidering operation requires only a single thread change, and can be performed with improved efficiency.

In some cases, however, the sewing order determined by the sewing order determining device of the "continuous same-thread embroidering type" is not suitable. That is, this type of sewing order determining device permits intended reproduction of the embroidery pattern 300 whose original pattern embroidering data are formulated such that the element 302, 306, 310 to be embroidered by the red thread is sewn before the element 304, 308, 312 to be embroidered by the blue thread, in all of the components "x", "y" and "z". However, this sewing order determining device does not permit the intended reproduction of the embroidery pattern 100 whose original pattern embroidering data are formulated such that the elements 102, 104 of the components "x" and "z" are embroidered by the red thread before the elements 106, 108 of the same components "x" and "z" to be embroidered by the blue thread, while on the other hand the element 110 of the component "y" is embroidered by the blue thread before the element 112 of the same component "y" to be embroidered by the red thread. In the component "y" of the embroidery pattern 100, the element 110 should be first embroidered by the blue thread so that the red thread of the subsequently embroidered element 112 overlies the previously embroidered blue thread in an overlapping portion 114 of the two elements 110, 112, as indicated in FIG. 6. If the sewing order of the elements 110, 112 of the component "y" was determined by the sewing order determining device of the continuous same-thread embroidering type, namely, if the element 112 was embroidered by the red thread before embroidering of the element 110 by the blue thread, the blue thread of the subsequently embroidered element 110 would overlie the red thread as indicated in FIG. 14.

It is also noted that jumping stitches having a comparatively large length are not desirable. The jumping stitches are stitches which extend between two different elements or components and which are formed when these elements or components are embroidered by the same thread. The length of the jumping stitches between the elements of the same component is generally small. Therefore, where the elements of one component are embroidered before the elements of any other component, the jumping stitches tend to have a short length. Where an embroidery pattern is embroidered according to pattern embroidering data processed by the sewing order determining device of the above-indicated continuous same-thread embroidering type, the length of the jumping stitches tends to be comparatively large. If this sewing order determining device is applied to the embroidery pattern 300 of FIG. 13 wherein the elements 304, 312 of the components "x" and "z" are embroidered by a blue thread while the element 308 of the component "y" is embroidered by a yellow thread, a jumping stitch of the blue thread from the element 304 to the element 310 has a comparatively large length. The required length of the thread increases with the length of such jumping stitches, and the efficiency of the embroidering operation is lowered with an increase in the number of the jumping stitches.

SUMMARY OF THE INVENTION

It is therefore a first object of the present invention to provide an embroidering data processing apparatus capable of determining the sewing order of the elements of an embroidery pattern so as to permit intended reproduction of the embroidery pattern while meeting predetermined requirements such as reduced lengths of jumping stitches and reduced number of thread changes required.

It is a second object of this invention to provide such an embroidering data processing apparatus which is effective to reduce the required number of thread changes.

It is a third object of this invention to provide such an embroidering data processing apparatus which permits easy generation of embroidering data.

It is a fourth object of this invention to provide such an embroidering data processing apparatus which permits effective utilization of the generated embroidering data.

It is a fifth object of this invention to provide such an embroidering data processing apparatus adapted to determine the sewing order of the elements of the embroidery pattern on the basis of the kinds of threads designated for those elements.

It is a sixth object of this invention to provide such an embroidering data processing apparatus which permits easy determination of the relative positions of a plurality of components of the embroidery pattern.

It is a seventh object of this invention to provide such an embroidering data processing apparatus including means suitable for achieving the first object indicated above.

It is an eighth object of this invention to provide such an embroidering data processing apparatus which is effective to reduce the required number of thread changes, without changing the sewing order of the elements in each component of the embroidery pattern.

It is a ninth object of this invention to provide an embroidering data processing apparatus including structure suitable for achieving the above eighth object.

It is a tenth object of the present invention to provide an embroidering data processing apparatus capable of determining the sewing order of the elements of an embroidery pattern so as to permit intended reproduction of the embroidery pattern while reducing the required number of thread changes.

It is an eleventh object of this invention to provide such an embroidering data processing apparatus which permits generation of a preferred form of embroidering data.

It is a twelfth object of the present invention to provide an embroidering data processing method which permits determination of the sewing order of the elements of an embroidery pattern so as to permit intended reproduction of the embroidery pattern while meeting predetermined requirements such as reduced lengths of jumping stitches and reduced number of thread changes required.

It is a thirteenth object of this invention to provide such an embroidering data processing method which permits determination of the sewing order of the elements without changing the sewing order of the elements in each component of the embroidery pattern.

It is a fourteenth object of the present invention to provide a recording medium which is accessible by a computer and which stores a sewing order determining program for determining the sewing order of the elements of an embroidery pattern as described above.

It is a fifteenth object of the present invention to provide a recording medium which is accessible by a computer and which stores ordered embroidering data processed such that the sewing order of the elements of an embroidery pattern is determined as described above.

It is a sixteenth object of the present invention to provide an embroidery sewing machine capable of performing a sewing operation according to such ordered embroidering data.

It is a seventeenth object of this invention to provide such an embroidery sewing machine wherein the ordered embroidering data are read from a recording medium as described above.

It is an eighteenth object of this invention to provide such an embroidery sewing machine capable of determining the sewing order of the elements of an embroidery pattern as described above.

It is a nineteenth object of this invention to provide such an embroidery sewing machine including a positioning device of simple construction for positioning a stitching device relative to a workpiece, so as to effectively achieve the above eighteenth object.

The first object described above may be achieved according to a first aspect of this invention, which provides an embroidering data processing apparatus comprising: (a; embroidering data memory for storing embroidering data for embroidering an embroidery pattern, the embroidering data including a batch of pattern embroidering data which include a plurality of component data sets for embroidering respective components of the embroidery pattern, each of the components consisting of at least one element, each of which is continuously embroidered by a same thread, the embroidering data memory storing the component data sets in a predetermined storing order; and (b) a sewing order determining program for determining a sewing order in which all of the elements included in the embroidery pattern are sequentially embroidered. The sewing order determining program is adapted to determine sewing order numbers of the elements of the embroidery pattern so as to satisfy at least one predetermined condition and such that the number of changes of threads required for embroidering the elements according to the sewing order numbers is smaller than that required for embroidering the elements of the components in the predetermined storing order.

The "at least one predetermined condition" may include, for example, at least one of the following conditions: a condition that the sewing order of the elements of each component determined by the sewing order determining program is consistent with the predetermined sewing order of the elements as represented by the component data sets stored in the embroidering data memory; a condition that the overlapping relation of the adjacent elements embroidered in the determined sewing order is consistent with the predetermined relation; and a condition that the length of jumping or bridging stitches between the different components is not larger than a predetermined threshold. The "changes of threads" are interpreted to include changing of at least one of the color, thickness, material, luster and other properties of the threads.

In the embroidering data processing apparatus of the present invention constructed as described above, the sewing order of the elements of the embroidery pattern is determined by the sewing order determining program so as to reduce the required number of thread changes while satisfying a predetermined condition or conditions.

If the pattern embroidering data for the embroidery pattern 100 as shown in FIG. 6 is processed by the present processing apparatus, the sewing order of the elements 102, 104, 106, 108, 110, 112 may be determined such that the elements 102, 104, 108, 110, 106 and 112 are embroidered in this order of description, with the red color thread used for the elements 102, 104 and 112 and with the blue color thread used for the elements 108, 110, 106. Therefore, the required number of thread changes according to the determined sewing order is "2" which is smaller than the required number "3" where the elements of the embroidery pattern 10 are embroidered in the order in which the corresponding element data sets are stored in the embroidering data memory. In the component "y", the element 110 for which the blue color is designated is embroidered before the element 112 for which the red color is designated. Therefore, the red thread overlies the blue thread in the overlapping portion 114. Namely, the overlapping portion 114 is covered by the red thread as intended. Thus, the sewing order of the elements 110, 112 of the component "y" determined by the sewing order determining program is consistent with the intended or predetermined sewing order. As explained above, the embroidering data processed by the present embroidering data processing apparatus permits reproduction of the embroidery pattern in the intended manner, with improved sewing efficiency.

Where the at least one predetermined condition includes a condition that the length of the jumping stitches between two different components is smaller than a predetermined threshold, the sewing order of the elements is determined to prevent successive embroidering actions of any two elements belonging to those two components, respectively, if the length of the jumping stitch or stitches between these components exceeds the predetermined threshold.

The second object described above may be achieved according to a first preferred form of the apparatus of this invention, wherein the sewing order determining program determines the sewing order numbers of the elements so as to minimize the number of changes of threads.

In the above form of the apparatus, the sewing order numbers of the elements are determined to minimize the required number of changes of the threads, to an extent possible to satisfy the predetermined condition or conditions described above. Where the embroidery pattern uses two different threads, for example, the smallest possible number of change of the threads is equal to "1" if it is not necessary to satisfy any other conditions. However, the embroidering of the embroidery pattern may require two or more changes of the threads, if any predetermined condition should be satisfied. The present arrangement assures maximum embroidering efficiency while satisfying the predetermined condition or conditions.

The third object described above may be achieved according to a second preferred form of the apparatus of this invention, which further comprises component data memory for storing a plurality of component data sets representative of components, and selective retrieval apparatus for selectively retrieving from the component data memory a plurality of the component data sets and storing the retrieved component data sets in the embroidering data memory in the predetermined storing order.

The component data memory may be a hard disk, a floppy disk, a ROM card or any other recording medium which is removably installed in the apparatus. Alternatively, the component data memory may be a random access memory which is adapted to temporarily store the component data sets received from a suitable external device such as a host computer.

In the above second preferred form of the embroidering data processing apparatus, the operator may retrieve from the component data memory the component data sets representative of the desired components, and the retrieved component data sets are stored in the embroidering data memory in the predetermined storing order. This arrangement does not require the operator to prepare or generate component data sets for embroidering the desired embroidery pattern, and therefore permits easy and efficient generation of the pattern embroidering data for embroidering the embroidery pattern desired by the operator.

The fourth object described above may be achieved according to a third preferred form of the apparatus of this invention, wherein the pattern embroidering data stored in the embroidering data memory as original pattern embroidering data are processed into ordered pattern embroidering data which are formulated to embroider the elements of the embroidery pattern according to the sewing order numbers determined by the sewing order determining program. In this case, the apparatus further comprises a recording device for recording the ordered embroidered pattern data in a removably installed recording medium. The removably installed recording medium may be a ROM card, a floppy disk or other magnetic recording medium, or a compact disk or other optical recording medium.

In the above third preferred form of the apparatus, the ordered pattern embroidering data obtained according to the determined sewing order numbers are stored by the recording device into the removably installed recording medium. The ordered pattern embroidering data stored in this recording medium may be used for an embroidering sewing machine equipped with a device for reading the ordered pattern embroidering data from the recording medium so that the embroidery pattern may be embroidered in the sewing order determined by the sewing order determining program. The embroidery sewing machine may be equipped with the embroidering data processing apparatus or may connected to the apparatus via a cable. However, the sewing machine need not be equipped with or connected to the processing apparatus, provided that the sewing machine is capable of utilizing the above-indicated recording medium which stores the ordered pattern embroidering data. In other words, the recording medium in which the ordered pattern embroidering data are stored by the present embroidering data processing apparatus may be used by a large number of embroidery sewing machines.

The fourth object may also be achieved according to a fourth preferred form of the apparatus of the invention, wherein the pattern embroidering data stored in the embroidering data memory are processed into the ordered pattern embroidering data as described above, and the embroidering data supplying apparatus is provided for supplying the ordered pattern embroidering data to an embroidery sewing machine. The embroidering data supplying apparatus may be adapted to send the entirety of the ordered pattern embroidering data continuously at one time, or send divided portions of the data intermittently. The sewing machine and the embroidering data supplying apparatus may be arranged such that the sewing machine performs an embroidering operation as the ordered pattern embroidering data are received from the embroidering data supplying apparatus.

In the above fourth preferred form of the apparatus, the ordered pattern embroidering data are supplied from the embroidering data supplying apparatus to an embroidery sewing machine, so that the embroidery pattern represented by the received embroidering data may be embroidered by the -sewing machine in the sewing order determined by the sewing order determining program, provided the sewing machine is capable of utilizing the ordered pattern embroidering data. Thus, the embroidery sewing machine need not be equipped with the present embroidery data processing apparatus, or need not be equipped with a device for reading the ordered pattern embroidering data stored in a removably installed recording medium as described above with respect to the third preferred form of the invention.

The fifth object described above may be achieved according to a fifth preferred form of the apparatus. In the fifth preferred form, the embroidering data memory includes thread designating data memory for storing thread designating data indicative of a kind of a thread used for embroidering each of the elements and the sewing order determining program determines the sewing order numbers of the elements on the basis of the thread designating data stored in the thread designating data memory. The thread designating data may include color designating data indicative of a color of the thread.

In the above fifth preferred form of the apparatus, the kind of the thread used for embroidering each element of the embroidery pattern is designated by the thread designating data and the sewing order numbers of the individual elements are determined on the basis of the thread designating data by the sewing order determining program. The determination of the sewing order numbers on the basis of the designated thread kinds used for the elements makes it possible to reduce the required number of thread changes. The thread designating data may designate the color of the thread used for each element.

The sixth object described above may be achieved according to a sixth preferred form of the apparatus, which further comprises a relative position determining program for determining relative positions of the plurality of components of the embroidery pattern.

In the above sixth preferred form of the apparatus, the relative positions of the components of the embroidery pattern are determined by the relative position determining program. Where the embroidery pattern consists of two or more components which are arranged in a row, the operator designates the distances or intervals between the adjacent components and the relative position determining program automatically determines the coordinate values of a reference point of each component on the basis of the designated distances or intervals. The reference point may be located at the leftmost uppermost position of each component. The provision of the relative position determining program eliminates the operator's manipulation to designate the coordinates of the reference points of all the components of the embroidery pattern, and consequently contributes to an improvement in the embroidering efficiency. The components of the embroidery pattern need not be arranged in a substantially straight row, but may be arranged as desired.

The seventh object described above may be achieved according to a seventh preferred form of the apparatus. In the seventh preferred form, the components of the embroidery pattern are arranged in a row, and the embroidering data storing program stores the component data sets in the predetermined storing order which corresponds to an order in which the components are arranged in the row. In this instance, the sew ng order determining program comprises: a thread designating program for sequentially designating a plurality of threads of different kinds in a predetermined order; a matching check program for effecting a matching check to determine whether each one of the at least one element of each of the plurality of components should be embroidered by the thread currently designated by the thread designating program and whether each one element indicated above satisfies the above-indicated at least one predetermined condition if this element is given a currently set sewing order number, the matching check program giving the currently set sewing order number to the element in question if an affirmative determination is obtained by the matching check; and a check control program for alternately changing a direction of the matching check of the elements of the embroidery pattern between a forward direction corresponding to the predetermined storing order and a backward direction opposite to the forward direction. The check control program is adapted to command the thread designating program for changing the currently designated thread to the next one when the direction of the matching check is changed.

In the above seventh preferred form of the apparatus, the matching check is effected by the matching check program to determine whether each element of each component of the embroidery pattern should be embroidered by the currently designated thread and whether this element satisfies the predetermined condition or conditions if the element is given a currently set sewing order number. The element in question is given the currently set sewing order number if the affirmative determination is obtained by the matching check. Further, the direction of the matching check of the elements is alternately changed between the forward and backward directions and the currently designated thread is changed to the next one when the direction of the matching check is changed. In the specific example of the embroidery pattern 100 shown in FIG. 6, the matching check of the components "x", "y" and "z" is first effected in the forward direction as "x"→"y"→"z", and is then effected in the backward direction as "z"→"y"→"x". The matching check is repeated in the forward and backward directions, alternately. Each time the direction of the matching check is changed, the currently designated thread is changed, for example, from the red thread to the blue thread.

The determination of the sewing order numbers of the elements of the embroidery pattern by the matching check effected alternately in the forward and backward directions assures that the determined sewing order numbers of the elements embroidered by the same thread are consistent with the order in which the elements are subjected to the matching check. In the example of FIGS. 6 and 7, the components "x", "y" and "z" include the elements 102, 112 and 104 which should be embroidered by the same thread (red thread), respectively, and the predetermined condition that should be satisfied is that the element 110 to be embroidered by the blue thread should be embroidered prior to the element 112 to be embroidered by the red thread. In this case, the sewing direction is determined so that the elements 102 and 104 are first embroidered in this order, that is, in the forward direction of the matching check. The element 110 of the component "y" is skipped because the red thread is designated in the forward matching check. Then, the matching check direction is changed to the backward direction, and the blue thread is designated, so that the elements 108, 110 and 106 are embroidered in this order, that is, in the backward direction of the matching check. The matching check direction is again changed to the forward direction, and the red thread is again designated, whereby the element 112 of the component "y" is given the last sewing order number. Therefore, the element 110 is embroidered prior to the element 112, that is, the above-indicated condition is satisfied. On the other hand, if the matching check is effected repeatedly always in the forward direction with the currently designated thread being changed each time the forward matching check is repeated, the forward elements 102 and 104 are embroidered in this order as in the above case, since the forward matching check is first effected with the red thread being designated. The second forward matching check is effected with the blue thread being designated, so that the elements 106 and 108 are embroidered in this order. Thus, the jumping stitches are created between the elements 102 and 104, and between the elements 106 and 108. Accordingly, the number of the jumping stitches is smaller in the present arrangement. If the embroidery pattern has a relatively large number of intermediate components similar to the component "y", the length of the jumping stitches tends to be considerably large where the matching check is repeatedly effected always in the forward or backward direction. In the example of the embroidery pattern 100 of FIGS. 6 and 7 embroidered according to the sewing order numbers determined in the present seventh preferred form of the invention, only one jumping stitch is required to satisfy the predetermined condition, namely, to embroider the element 110 prior to the element 112.

The eighth object described above may be achieved according to an eighth preferred form of the apparatus. In the eighth preferred form, each of the component data sets of the embroidery pattern consists of a plurality of element data sets for embroidering a plurality of elements, respectively, and the embroidering data memory stores the plurality of element data sets of each component data set such that the element data sets are stored in a state which is indicative of a predetermined sewing order of the plurality of elements within each component, and wherein the at least one predetermined condition includes a condition that the sewing order numbers of the elements of each component which are determined by the sewing order determining program are consistent with the predetermined sewing order.

In the above eighth preferred form of the apparatus, the element data sets of each component data set are stored in such a state as to indicate the predetermined sewing order of the elements within the corresponding component. For instance, the element data sets of each component data set are stored in the predetermined sewing order of the corresponding elements within the component. Alternatively, the element data sets are stored together with data indicative of the sewing order of the elements. Further, the sewing order numbers of the elements of each component are determined so that the determined sewing order numbers are consistent with the predetermined sewing order as represented by the state in which the element data sets are stored. This arrangement permits the overlapping portions of the adjacent elements within a component to be embroidered as intended. In the example of FIG. 6, the red thread should overlie the blue thread in the overlapping portion 114 of the elements 110 and 112 of the component "y". As described above, the element 110 is given the fourth sewing order number while the element 112 is given the sixth sewing order number, so that the element 110 is embroidered by the blue thread prior to the element 112 embroidered by the red thread, whereby the overlapping portion 114 is covered by the red thread as intended. According to the predetermined sewing order of the elements 110, 112, the elements 110, 112 are embroidered in this order, which is consistent with the sewing order numbers given to these elements 110, 112.

The ninth object indicated above may be achieved according to one advantageous arrangement of the above eighth preferred form of the apparatus wherein the components of the embroidery pattern are arranged in a row, the embroidering data storing program stores the plurality of component data sets in the predetermined storing order which corresponds to an order in which the components are arranged in the row, and wherein the embroidering data memory includes thread designating data memory for storing thread designating data indicative of a kind of a thread used for embroidering each of the elements. In the present arrangement, the sewing order determining program comprises: a thread designating program for sequentially designating a plurality of threads of different kinds in a predetermined order; a matching check program for effecting a matching check to determine whether the kind of the thread designated by the thread designating data for each one of the plurality of elements within each component is coincident with the kind of the thread currently designated by the thread designating program, the matching check program giving a currently set sewing order number to that above-indicated one element if an affirmative determination is obtained by the matching check and if the sewing order number of the element has not been determined, the matching check of the plurality of elements within each component being effected in the predetermined sewing order of the elements within each component; and a check control program for alternately changing a direction of the matching check of the elements of the embroidery pattern between a forward direction corresponding to the predetermined storing order and a backward direction opposite to the forward direction, the check control program commanding the thread designating program for changing the currently designated thread to the next one when the direction of the matching check is changed.

In the above advantageous arrangement, the direction of the matching check is alternately changed between the forward and backward directions, as in the apparatus according to the seventh preferred form of the invention. In the present arrangement, the matching check of the elements within each component is effected in the predetermined sewing order of the element of each component, and the matching check is effected to determine whether the kind of the thread designated by the thread designating data for the element in question is coincident with the kind of the thread currently designated by the thread designating program. In the embroidery pattern 100 of FIG. 6, for example, the element 102 is given the currently set sewing order number in the forward matching check with the red thread being designated, if the sewing order number of the element 102 has not been determined. If the element 102 has been given the sewing order number, the element 104 is given the currently set sewing order number in the forward matching check.

In the above arrangement, the element 112, which should be embroidered after the element 110 according to the predetermined sewing order within the component "y", will not be embroidered before the element 110 according to the sewing order numbers determined by the sewing order determining program in the above advantageous arrangement including the matching check program and check control program.

The tenth object described above may be achieved according to a second aspect of the present invention, which provides an embroidering data processing apparatus comprising: (a) a selecting program for selecting desired component data sets from among a plurality of component data sets for embroidering respective components each of which consists of at least one element, each element being continuously embroidered by a same thread, the desired component data sets being used to embroider a desired embroidery pattern, the plurality of component data sets including at least one color changing data set, each being indicative of a change of color of the thread; (b) a thread change reducing program for processing the desired component data sets selected by the selecting program, such that the number of changes of color of the thread required for embroidering the embroidery pattern according to the processed desired component data sets is smaller than that required for embroidering the embroidery pattern according to the desired component data sets as selected by the selecting program; and (c) a sewing order coordinating program for coordinating a sewing order of the elements of the components represented by the selected desired component data sets, so as to avoid a drawback which would take place if the elements were embroidered according to the component data sets as processed by the thread change reducing program to reduce the number of changes of the thread color.

The "drawback" indicated above may be a drawback as illustrated in FIG. 14, namely, the overlapping portion 114 which is undesirably covered by the blue thread and which should be covered by the red thread as shown in FIG. 6.

The "color changing data set" may directly or indirectly indicate a change of the thread color. The indirect indication of the thread color change may be achieved when the color designating data indicative of the thread color for each element are changed.

In the embroidering data processing apparatus according to the present second aspect of this invention, the component data sets are processed by the thread change reducing program so as to reduce the number of changes of the thread color, thereby improving the efficiency of embroidering of the embroidery pattern according to the processed component data sets. Further, the sewing order coordinating program is adapted to prevent any drawback which would take place if the elements were embroidered according to the component data sets as processed by the thread change reducing program. Therefore, the present apparatus permits reproduction of the embroidery pattern in the intended manner.

In one preferred form of the apparatus according to the second aspect of the invention described above, the thread change reducing program minimizes the number of the changes of color of thread. This arrangement permits the minimum number of thread color changes while assuring the intended reproduction of the embroidery pattern.

The eleventh object indicated above may be achieved according to a second preferred form of the apparatus according to the second aspect of the invention, wherein each of the plurality of component data sets consists of at least one element data set for embroidering the at least one element, respectively, and each element data set includes outline data defining an outline of the element.

The eleventh object may also be achieved according to a third preferred form of the above apparatus, wherein each of the plurality of component data sets consists of at least one element data set for embroidering the at least one element, respectively, and each element data set includes stitch position data representative of positions at which stitches are formed by the thread.

The outline data may be at least one mathematical equation representative of the outline (including straight lines and curves) of an element, two or more sets of vector data representative of segments of the outline, or data representative of points which define the configuration of the element. Where the outline of an element is a circle, for example, the circle may be defined by the center point and the radius of the circle, or by a mathematical equation.

Where the element data sets are outline data, the amount of the embroidering data (component data sets) processed by the apparatus can be made comparatively small, and the required capacity of the memory for storing the processed embroidering data can be accordingly reduced. Where the element data sets are stitch position data representative of the stitch positions, the stitch position data may be directly used for controlling the relative position of the sewing needle and the workpiece, and therefore an embroidery sewing machine using the stitch position data is not require to have a high data processing function.

The twelfth object described above may be achieved according to a third aspect of the present invention, which provides a method of processing embroidering data including a batch of pattern embroidering data for embroidering an embroidery pattern, the batch of pattern embroidering data including a plurality of component data sets for embroidering respective components, each of which consists of at least one element, each element continuously embroidered by a same thread. The method comprises: (a) storing the batch of pattern embroidering data in embroidering data memory such that the plurality of component data sets are stored in a predetermined storing order; and (b) determining a sewing order in which all of the elements included in the embroidery pattern are sequentially embroidered, so as to satisfy at least one predetermined condition, and such that the number of changes of threads required for embroidering the elements in the determined sewing order is smaller than that required for embroidering the elements of the components in the predetermined storing order.

In the embroidering data processing method of the invention, the sewing order of all the elements in the embroidery pattern is determined so as to satisfy at least one predetermined condition and to minimize the required number of changes of threads. The present method may be suitably practiced by the apparatus constructed according to the first aspect of the invention.

The thirteenth object described above may be achieved according to one preferred form of the present method, wherein each of the plurality of component data sets of the embroidery pattern consists of a plurality of element data sets for embroidering a plurality of elements, respectively, each component data set being formulated such that the plurality of elements within each component are embroidered in a predetermined order, and wherein the at least one predetermined condition includes a condition that the determined sewing order of the plurality of elements of each component is consistent with the predetermined order within each component. According to this arrangement, the overlapping portion of the adjacent elements within a component is covered by the desired thread.

The fourteenth object indicated above may be achieved according to a fourth aspect of the present invention, which provides a recording medium storing a sewing order determining program for processing embroidering data for embroidering an embroidery pattern, the embroidering data including a batch of pattern embroidering data which include a plurality of component data sets for embroidering respective components of the embroidery pattern, each of the components consisting of at least one element, each element continuously embroidered by a same thread, the sewing order determining program being formulated to determine a sewing order in which all of the elements included in the embroidering pattern are sequentially embroidered, so as to satisfy at least one predetermined condition, and such that the number of changes of threads required for embroidering the elements in the sewing order determined according to the sewing order determining program is smaller than that required for embroidering the embroidery pattern such that the components are sequentially embroidered in a predetermined order.

In one preferred form of the recording medium of the fourth aspect of the invention, the components of the embroidery pattern are arranged in a row, and the sewing order determining program is formulated to determine the sewing order such that the number of the changes of threads required for embroidering the elements according to the determined sewing order is smaller than that required for embroidering the components in an order in which the components are arranged.

The fifteenth object indicated above may be achieved according to a fifth aspect of this invention, which provides a recording medium storing embroidering data for embroidering an embroidery pattern consisting of a plurality of components each of which consists of at least one element, each element continuously embroidered by a same thread, the plurality of components including at least two components, each of which includes at least two elements that should be embroidered by respective different threads, the embroidering data being formulated such that a sewing order in which all of the elements included in the embroidery pattern are embroidered is determined such that a sewing order of the at least two elements of one of the at least two components is different from a sewing order of the at least two elements of another of the at least two components, and such that the number of changes of the threads required for embroidering the embroidery pattern in the determined sewing order is smaller than that required for embroidering the embroidery pattern such that the plurality of components are sequentially embroidered in a predetermined order.

The recording medium according to the fourth and fifth aspects of the invention may be any medium, provided the sewing order determining program or the embroidering data can be read out from that medium by a computer. For instance, the recording medium may be a ROM chip, an EPROM chip, a hard disk or any other medium which is fixedly provided in an embroidering data processing apparatus, or a ROM card, a floppy disk, a compact disk or any other medium which is removably installed on the embroidering data processing apparatus. The recording medium according to the fifth aspect of the invention stores the embroidering data which is obtained according to the sewing order determining program stored in the recording medium according to the fourth aspect of the invention. The sewing order determining program may be considered as an embroidering data processing program.

Where the recording medium is a ROM chip, the embroidering data processing apparatus equipped with the sewing order determining program according to the first aspect of the invention is available at a reduced cost. Where the recording medium is a floppy disk, it can be used by an ordinary personal computer (wherein the sewing order determining program is not stored in a built-in ROM), for determining the sewing order of the elements of the embroidery pattern. The recording medium according to the fourth aspect of the invention may be suitably used on the embroidering data processing apparatus according to the first and second aspects of the invention, to practice the data processing method according to the third aspect of the invention.

The recording medium according to the fourth aspect of the invention may store various programs for achieving the features which have been described above with respect to the sewing order determining program of the apparatus according to the first aspect of the invention, and the thread change reducing program and sewing order coordinating program of the apparatus according to the second aspect of the invention. The same recording medium may store programs for achieving the features which have been described above with respect to the component data memory, recording device, embroidering data supplying program and relative position determining program. Where the components of an embroidery pattern are arranged in a row, the sewing order determining program stored in the recording medium may be formulated to determine the sewing order such that the number of thread changes required for embroidering the elements according to the determined sewing order is smaller than that required for embroidering the components in an order in which the components are arranged. In this case, the recording medium desirably stores a program for determining the relative position of the components.

The embroidering data stored in the recording medium according to the fifth aspect of this invention is formulated such that the components of the embroidery pattern include at least two components, each of which includes at least two elements that should be embroidered by respective different threads, and such that a sewing order in which all of the elements included in the embroidery pattern are embroidered is determined such that a sewing order of the above-indicated at least two elements of one of the above-indicated at least two components is different from a sewing order of the above-indicated two elements of another of the above-indicated two components, and such that the number of changes of the threads required for embroidering the embroidery pattern in the determined sewing order is smaller than that required for embroidering the embroidery pattern such that the components are sequentially embroidered in a predetermined order. Thus, the embroidering data stored in the recording medium is formulated not only for maximizing the number of the elements that are successively embroidered by the same thread, but also for assuring reproduction of the embroidery pattern in the intended manner, while satisfying the predetermined condition or conditions.

The recording medium storing the embroidering data according to the fifth aspect of this invention can be used by an embroidery sewing machine equipped with a device capable of reading the embroidering data from that medium so that an embroidery pattern can be embroidered with high efficiency in the sewing order as determined by the embroidering data. The embroidering data stored in the present recording medium may be generated by the embroidering data processing apparatus according to the first aspect of this invention, or obtained by practicing the method according to the third aspect of the invention. Further, the embroidering data stored in the present recording medium may be generated according to the sewing order determining program stored in the recording medium according to the fourth aspect of the invention.

The sixteenth object described above may be achieved according to a sixth aspect of the present invention, which provides an embroidery sewing machine comprising: (a) a stitching device for forming stitches on a workpiece; (b) a positioning device for positioning the workpiece and the stitching device relative to each other in a plane parallel to a plane of the workpiece; and (c) a control device for controlling the stitching device and the positioning device, wherein the control device comprises an embroidering data supplying program for supplying the stitching device with embroidering data including ordered pattern embroidering data for embroidering an embroidery pattern consisting of a plurality of components, each of which consists of at least one element, each element continuously embroidered by a same thread, the plurality of components including at least two components, each of which includes at least two elements that should be embroidered by respective different threads. The ordered pattern embroidering data of the embroidering data supplied from the control device are formulated such that a sewing order in which all of the elements included in the embroidery pattern are embroidered is determined such that a sewing order of the above-indicated at least two elements of one of the at least two components is different from a sewing order of the above-indicated at least two elements of another of the above-indicated at least two components, and such that the number of changes of the threads required for embroidering the embroidery pattern in the determined sewing order is smaller than that required for embroidering the embroidery pattern such that the plurality of components are sequentially embroidered in a predetermined order.

The positioning device may be adapted to move only the stitching device relative to the workpiece in the plane parallel to the workpiece surface, or move only the workpiece relative to the stitching device, or alternatively move both of the stitching device and the workpiece relative to each other.

In one preferred form of the embroidery sewing machine of this invention, the control device includes a device for retrieving the embroidering data from a removably installed recording medium.

In a second preferred form of the present embroidery sewing machine, the control device includes an embroidering data processing apparatus comprising: (a) embroidering data memory for storing non-ordered pattern embroidering data consisting of a plurality of component data sets for embroidering the plurality of components of the embroidery pattern, the embroidering data memory storing the component data sets in a predetermined storing order; and (b) a sewing order determining program for determining the sewing order in which all of the elements included in the embroidery pattern are sequentially embroidered. In the present sewing machine, the sewing order determining program is adapted to determine sewing order numbers of the elements of the embroidery pattern, so as to satisfy at least one predetermined condition, and such that the number of changes of threads required for embroidering the elements according to the sewing order numbers is smaller than that required for embroidering the elements of the components in the predetermined storing order, so that the ordered pattern embroidering data are obtained on the basis of the non-ordered pattern embroidering data stored in the embroidering data memory and the sewing order numbers determined by the sewing order determining program.

In a third preferred form of the embroidery sewing machine of the invention, the ordered pattern embroidering data include relative position data representative of amounts of relative movements of the stitching device and the workpiece, and the embroidering data supplying program supplies the relative position data to the positioning device.

In the embroidery sewing machine according to the sixth aspect of the present invention, the embroidering data including the ordered embroidery pattern data are supplied from the control device to the positioning device, so that the stitching device and the workpiece are moved relative to each other according to the supplied embroidering data. The embroidering data may be received from an external device or obtained by the control device of the sewing machine. Where the embroidering data are received from an external device, the sewing machine may be connected to the external device through a communication line. Alternatively, the sewing machine may be adapted to receive a removably installed recording medium which stores the embroidering data. In this case, the sewing machine is equipped with suitable structure for receiving the embroidery data transmitted from the external device, or a device for retrieving the embroidery data from the removably installed recording medium as provided in the above-described first preferred form of the sewing machine described above. Where the embroidering data are obtained by the control device of the sewing machine per se, the sewing machine is provided with the embroidering data processing apparatus as provided in the second preferred form of the sewing machine described above. In either case, the present embroidery sewing machine is capable of forming a desired embroidery pattern with high efficiency according to the embroidering data. Where the embroidering data is equipped with a device for retrieving the embroidering data from a removably installed recording medium, the recording medium according to the fifth aspect of this invention may be suitably used.

Where the embroidery sewing machine is equipped with an embroidering data processing apparatus as described above with respect to the second preferred form of the sewing machine, the embroidery sewing operation is performed according to the embroidering data obtained by the processing apparatus. The processing apparatus may be constructed as described above with respect to the first aspect of the invention, and may use the sewing order determining program stored in the recording medium according to the fourth aspect of the invention, or may be adapted to practice the embroidering data processing method according to the third aspect of the invention. The control device of the present embroidery sewing machine may be equipped with both of the embroidering data retrieving device according to the first preferred form of the sewing machine, and the embroidering data processing apparatus according to the second preferred form of the sewing machine. In the third preferred form of the sewing machine, the relative position data representative of the amounts of relative movements of the stitching device and the workpiece are supplied to the positioning device. In this case, the relative position data may be directly used to control the relative position of the stitching device and the workpiece, without data processing by the control device as required where the components of the embroidery pattern are defined by outline data representative of elements of the components as described above.

While the various forms and arrangements of the various aspects of the present invention have been described above, the present invention may be otherwise embodied.

For instance, the embroidering data processing apparatus according to the first aspect of the invention may be adapted such that the embroidering data memory includes sewing order designating data memory for storing sewing order designating data representative of a predetermined sewing order of the elements included in each of the components of the embroidery pattern. In this case, the sewing order determining program determines the sewing order numbers of the elements of each component such that the determined sewing order numbers are consistent with the predetermined sewing order represented by the sewing order designating data.

Further, the apparatus according to the first aspect of the invention may be adapted such that where the components of the embroidery pattern are arranged in a row, the embroidering data memory stores the component data sets in an order in which the components are arranged in the row, and the sewing order determining program comprises: a thread designating program for sequentially designating a plurality of threads of different kinds in a predetermined order; a forward matching check program for effecting a forward matching check to determine whether each one of the elements within each component of the embroidery pattern should be embroidered by the kind of thread currently designated by the thread designating program, and giving a currently set sewing order number to the element in question if an affirmative determination is obtained by the forward matching check and if the above-indicated at least one predetermined condition is satisfied when the currently set sewing order number is given to the element in question, the forward matching check being effected in a forward direction corresponding to the order in which the components are arranged; a backward matching check program for effecting a backward matching check similar to the forward matching check, in a backward direction opposite to the forward direction; and a changing program for alternately operating the forward and backward matching check program and commanding the thread designating program for changing the currently designated thread to the next one when the operated matching check program is changed from the forward matching check program to the backward matching check program or vice versa.

The embroidery data processing apparatus according to the eighth preferred form of the apparatus according to the first aspect of the invention described above may be adapted such that where the components of the embroidery pattern are arranged in a row, the embroidering data storing program stores the component data sets in an an order in which the components are arranged in the row, and includes thread designating data memory for storing thread designating data indicative of a kind of a thread used for embroidering each of the elements, and such that the sewing order determining program comprises: a thread designating program for sequentially designating a plurality of threads of different kinds in a predetermined order; a forward matching check program for effecting a forward matching check to determine whether the kind of the thread designated by the thread designating data for each one of the elements within each component of the embroidery pattern is coincident with the kind of the thread currently designated by the thread designating program, and giving a currently set sewing order number to the element in question if an affirmative determination is obtained by the forward matching check, the forward matching check being effected in a forward direction corresponding to the order in which the components are arranged; a backward matching check program for effecting a backward matching check similar to the forward matching check, in a backward direction opposite to the forward direction; and a changing program for alternately operating the forward and backward matching check program and commanding the thread designating program for changing the currently designated thread to the next one when the operated matching check program is changed from the forward matching check program to the backward matching check program or vice versa.

The apparatus described immediately above may include an element designating program for sequentially designating the elements which are subjected to the forward and backward matching checks.

The method according to the third aspect of this invention may be adapted such that each component data set includes a sewing order designating data representative of a predetermined sewing order of the elements included in the corresponding component, and such that the step of determining the sewing order comprises determining the sewing order such that the determined sewing order of the elements of the embroidery pattern is consistent with the predetermined sewing order of the elements within each component.

The present invention encompasses an embroidering data processing method that is practiced by any apparatus according to the first and second aspects of the invention which have been described above.

The present invention also encompasses a recording medium which is accessible by a computer and which stores embroidering data obtained by any apparatus according to the first and second aspect of the invention.

The present invention further encompasses a recording medium which is accessible by a computer and which stores embroidering data obtained by practicing any method according to the third aspect of this invention.

The present invention also encompasses a recording medium which is accessible by a computer and which stores a sewing order determining program used by any apparatus according to the first and second aspects of the invention.

The recording medium storing the sewing order determining program may be a ROM chip, a hard disk or any other medium which is fixedly installed in the embroidering data processing apparatus, or a floppy disk, a ROM card or any other medium removably installed in the apparatus.

The present invention further encompasses an embroidery sewing machine equipped with any embroidering data processing apparatus according to the first and second aspects of the invention.

The present invention also encompasses an embroidery data processing apparatus which includes the removably installed recording medium according to the fourth aspect of the invention, and a device for retrieving the sewing order determining program from this removably installed recording medium.

The present invention also encompasses a method of embroidering an embroidery pattern consisting of a plurality of components each consisting of at least one element which is continuously embroidered by a same thread, comprising the steps of: storing a batch of non-order pattern embroidering data into pattern embroidering data memory, the pattern embroidering data consisting of a plurality of component data sets for embroidering the plurality of components, respectively, such that the component data sets are stored in a predetermined storing order; determining a sewing order in which all of the elements included in the embroidery pattern are sequentially embroidered, so as to satisfy at least one predetermined condition, and such that the number of changes of threads required for embroidering the elements in the determined sewing order is smaller than that required for embroidering the elements of the components in the predetermined storing order, ordered pattern embroidering data being obtained on the basis of the non-ordered pattern embroidering data stored in the pattern embroidering data memory and the determined sewing order; and forming stitches to embroider the embroidery pattern on a workpiece by moving a stitching device and the workpiece according to the ordered pattern embroidering data, in a plane parallel to a plane of the workpiece.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which:

FIG. 9 is a view indicating legends representative of various data used in the sewing order determining routine, and initial states of the data;

FIG. 11 is a view schematically showing ordered pattern embroidering data generated by the embroidering data processing apparatus;

DETAILED DESCRIPTION OF THE PREFERRED EMBODIMENTS

Referring to the accompanying drawings, there will be described in detail an embroidery sewing machine constructed according to one embodiment of this invention, which includes a personal computer functioning as one embodiment of an embroidering data processing apparatus of the invention, which is adapted to practice one embodiment of an embroidering data processing method of the invention.

Figure 1:
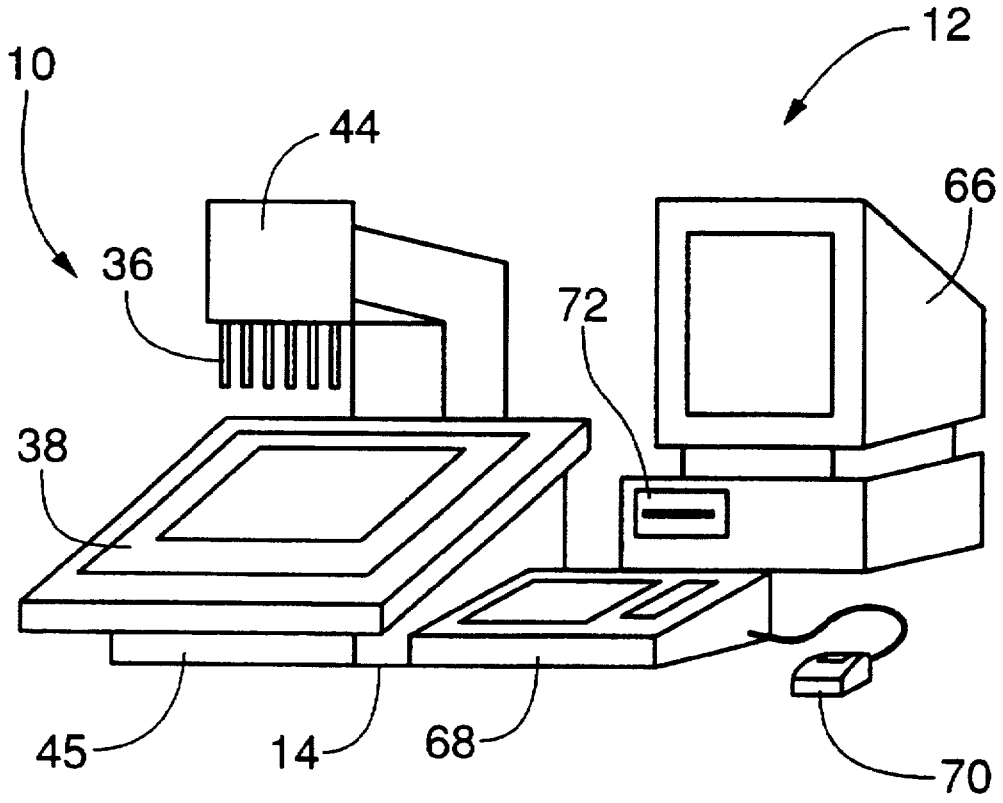
FIG. 1 is a perspective view showing an embroidery sewing machine constructed according to one embodiment of the present invention.

In FIG. 1, the embroidery sewing machine includes a sewing section 10 and a personal computer 12 which are connected to each other by a cable 14. The sewing section 10 is well known in the art. An example of the sewing section 10 is disclosed in U.S. Pat. No. 5,159,885, the disclosure of which is herein incorporated by reference. The sewing section 10 is arranged to perform an embroidering operation according to embroidering data received from the personal computer 12 via the cable 14.

Figure 2:
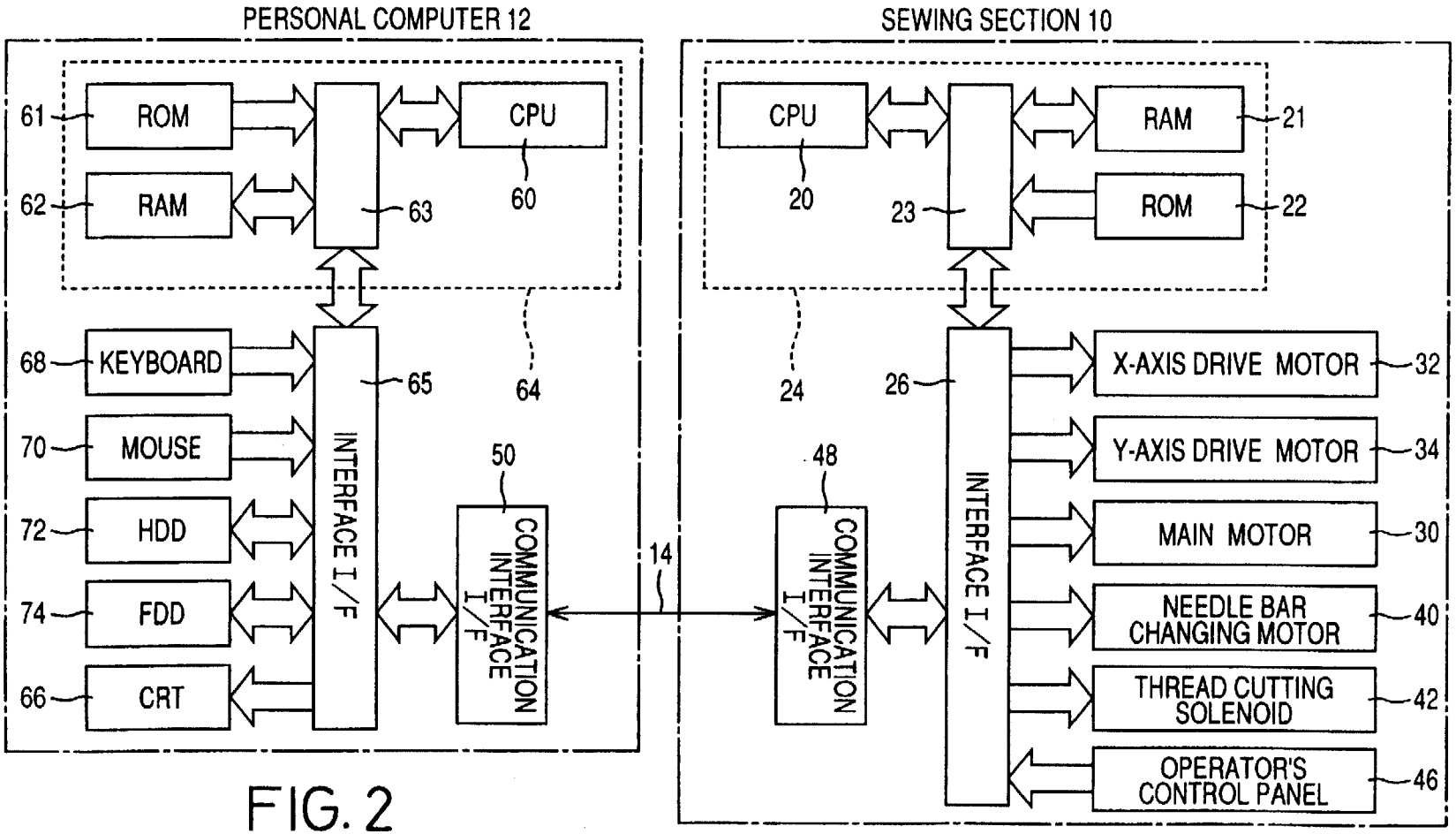
FIG. 2 is a block diagram showing the embroidery sewing machine of FIG. 1.

As shown in FIG. 2, the sewing section 10 is equipped with an embroidering control device 24 which is constituted principally by a computer incorporating a central processing unit (CPU) 20, a random-access memory (RAM) 21, a read-only memory (ROM) 22, and a bus 23. To the embroidering control device 24, there are connected a main motor 30, an X-axis drive motor 32 and a Y-axis drive motor 34 through an interface (I/F) 26 and respective driver circuits (not shown). The sewing section 10 has a needle bar support casing 44 which carries a plurality of vertically reciprocable needle bars 36, and a work holder 38 which holds a work fabric and which is movable in mutually perpendicular X-axis and Y-axis directions. A selected one of the needle bars 36 is vertically reciprocated by the main motor 30, and the work holder 38 is moved in the X-axis and Y-axis directions by the X-axis and Y-axis driver motors 32, 34, respectively. The work holder 38 takes the form of a rectangular frame by which the work fabric is held in a horizontal plane perpendicular to the direction of reciprocation of the selected needle bar 36. The selected needle bar 36 and the work holder 38 constitute a part of a stitch forming device, which is adapted to form stitches on the work fabric by movements of the work holder 38 in the X-axis and Y-axis directions and reciprocating movements of the needle bar 36. The X-axis and Y-axis drive motors 32, 34 constitute a major part of a positioning device for positioning the work fabric and the stitch forming device relative to each other. The ROM 22 of the sewing section 10 stores an embroidering control program for executing an embroidering routine illustrated in the flow chart of FIG. 3.

To the interface 26, there are also connected a needle bar changing motor 40 and a thread cutting solenoid 42 through respective driver circuits (not shown). When the needle bar changing motor 40 is operated, the needle bar support casing 44 is moved to bring a selected one of the needle bars 36 to an operating position. To the needle bars 36, there are attached respective needles having respective threads inserted therethrough. The threads have respective different colors which are designated by thread designating data included in the embroidering data. Since the needle bar changing motor 40 is provided to change the thread or the color of the thread used, the motor 40 may be referred to as a thread changing motor or a color changing motor. The thread cutting solenoid 42 is energized to activate a thread cutter disposed within a bed 45 of the sewing section 10, for cutting the thread.

A communication interface (I/F) 48 is also connected to the interface 26. While an operation of the sewing section 10 may be controlled through an operator's control panel 46, it may be controlled by signals received from the personal computer 12 through the cable 14 and the communication interface 48. As shown in FIG. 2, the communication interface 48 of the sewing section 10 is connected through the cable 14 to a communication interface (I/F) 50 of the personal computer 12, so that the embroidering data from the personal computer 12 are received by the communication interface 48.

The personal computer 12 includes a control portion 64 incorporating a central processing unit (CPU) 60, a read-only memory (ROM) 61, a random-access memory (RAM) 62 and a bus 63. The computer 12 further includes the above-indicated communication interface 50, an interface (I/F) 65 connected to the communication interface 50, a display (CRT) 66, a keyboard (K/B) 68, a mouse 70, a hard disk drive (HDD) 72 and a floppy disk drive (FDD) 74. The display 66, keyboard 68, mouse 70, hard disk drive 72 and floppy disk drive 74 are connected to the control portion 64 through the interface 65 and respective driver circuits (not shown).

Figure 5A:
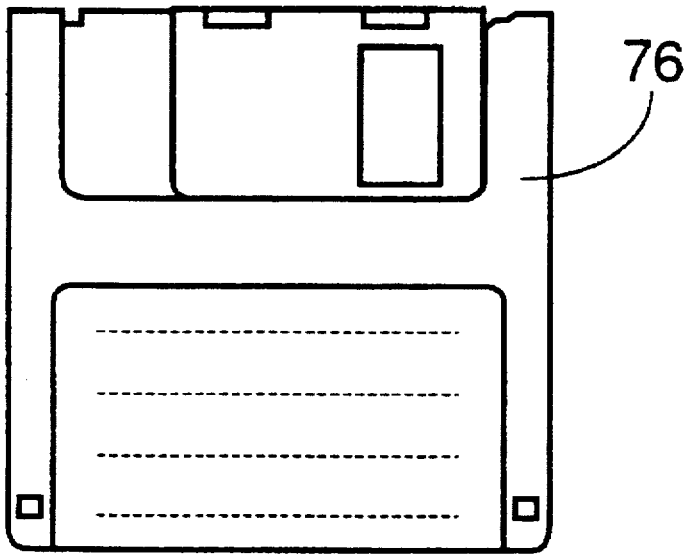
FIG. 5A is a plan view of a floppy disk which stores ordered pattern embroidering data generated by the embroidering data processing apparatus.

The display 66 provides various indications associated with an operation of the personal computer 12, and indications as a result of operations of the keyboard 68 and mouse 70 by the operator to control the personal computer 12 and to enter various data such as original embroidering data. The original embroidering data entered through the keyboard 68 and/or the mouse 70 by the operator are stored in a hard disk through the hard disk drive 72. As described below in detail, the original embroidering data are processed by the computer 12 according to an embroidering data processing program including a sewing order determining program, and the processed embroidering data are stored in the hard disk through the hard disk drive 72 and a floppy disk 76 as shown in FIG. 5A through the floppy disk drive 74.

The ROM 61 of the control portion 64 of the computer 12 stores the above-indicated embroidering data processing program including a sewing order determining program. The embroidering data processing program is provided to execute an embroidering data processing routine illustrated in the flow chart of FIG. 4, and includes the above-indicated sewing order determining program for executing a sewing order determining routine illustrated in the flow chart of FIG. 8. The ROM 61 further stores a relative position determining program for determining the coordinate values of a reference point of each operator-designated component of an embroidery pattern. For instance, the reference point is located at the leftmost and uppermost position of each component. The RAM 62 is used to temporarily store various data such as component data sets of pattern embroidering data, which data sets have been read out from a hard disk through the hard disk drive 72 by operator's manipulation of the keyboard 68 or mouse 70. Namely, a hard disk is used to store component data sets representative of commonly or frequently used components of embroidery patterns, such as alphabetic characters "A" through "Z" and "a" through "z". When the operator enters a batch of original pattern embroidering data for embroidering a desired embroidery pattern, the operator designates a desired combination of such characters as components of the embroidery pattern, to retrieve the corresponding component data sets from the hard disk.

As indicated above, a batch of original pattern embroidering data for embroidering an embroidery pattern is processed by the computer 12 according to the sewing order determining program, as described below in detail, and the processed pattern embroidering data (hereinafter referred to as "ordered pattern embroidering data") are stored in the floppy disk 76 through the floppy disk drive 74, and in the hard disk through the hard disk drive 72. Embroidering data including the ordered pattern embroidering data stored in the hard disk are transmitted through the communication interface 50 and cable 14 to the communication interface 48 of the sewing portion 10 of the embroidery sewing machine. The embroidering data received by the communication interface 48 are stored in the RAM 21 of the embroidering control device 24, so that an embroidering operation is performed by the sewing portion 10 according to the embroidering data stored in the RAM 21. In the present embodiment, the ordered pattern embroidering data for embroidering an embroidery pattern include stitching data in the form of relative movement data (stitch position data) indicative of the amounts of movements of the work holder 38 in the X-axis and Y-axis directions, so that the X-axis and Y-axis drive motors 32, 34 are moved according to the relative movement data to move the work holder 38 (work fabric) relative to the needle of the selected needle bar 36 placed in the operating position. If the ordered pattern embroidering data obtained by processing of the original pattern embroidering data by the computer 12 according to the sewing order determining program are stored in a removable recording medium such as the floppy disk 76, this recording medium may be used in an embroidery sewing machine not equipped with the computer 12, as long as the sewing machine is equipped with a device for reading and utilizing such ordered pattern embroidering data stored in the recording medium.

Figure 5B:
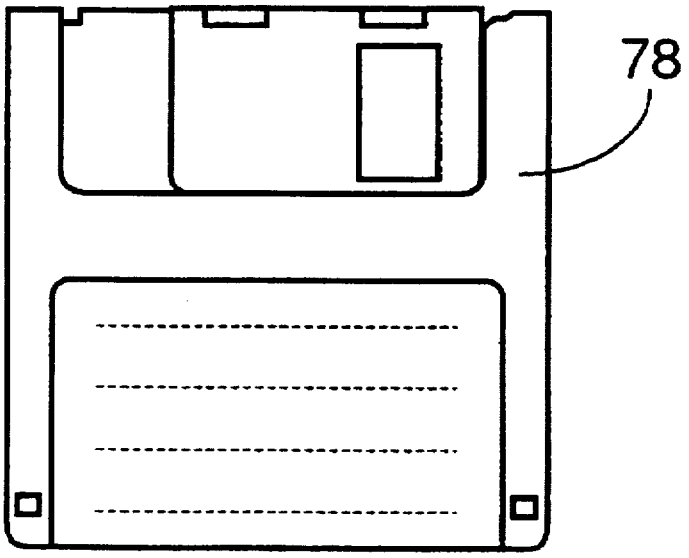
FIG. 5B is a plan view of a floppy disk storing sewing order determining program.

The embroidering data processing program including the sewing order determining program, and the relative position determining program may be stored in the hard disk or in a floppy disk 78 as shown in FIG. 5B, rather than the ROM 61. In this case, the required data storage capacity of the ROM 61 can be reduced.

Figure 4:
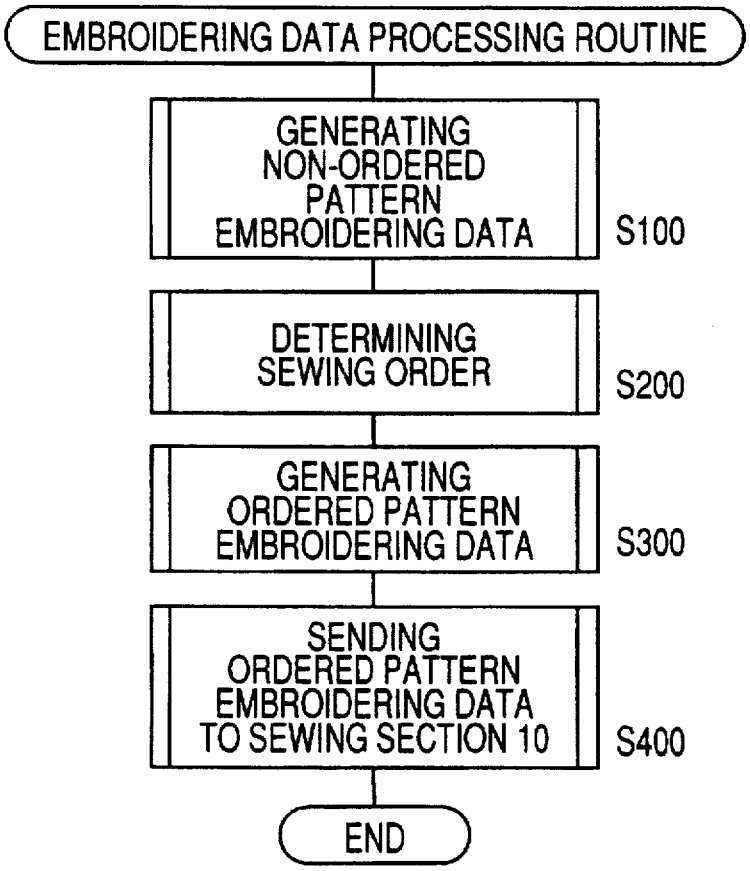
FIG. 4 is a flow chart illustrating an embroidering data processing routine executed according to an embroidering data processing program stored in a ROM of a control portion of an embroidering data processing apparatus of the sewing machine.

Referring to the flow chart of FIG. 4, there will be briefly described an embroidering data processing routine executed according to the embroidering data processing program stored in the ROM 61, hard disk or floppy disk 78. The embroidering data processing routine of FIG. 4 is initiated with step S100 in which non-ordered pattern embroidering data are generated on the basis of the original pattern embroidering data entered by operator's manipulation of the keyboard 68 or mouse 70 to designate component data sets which are stored in the hard disk and which represent respective components of a desired embroidery pattern that are arranged in a substantially straight row in a predetermined order. Then, the control flow goes to step S200 in which the sewing order in which all of the elements of the embroidery pattern are embroidered is determined according to the sewing order determining program which will be described by reference to the flow chart of FIG. 8. Step S200 is followed by step S300 in which ordered pattern embroidering data are generated on the basis of the original pattern embroidering data and the determined sewing order of the elements of the embroidery pattern. The control flow then goes to step S400 in which the ordered pattern embroidering data are stored in the hard disk through the hard disk drive 72, and are transmitted to the sewing portion 10.

Figure 3:
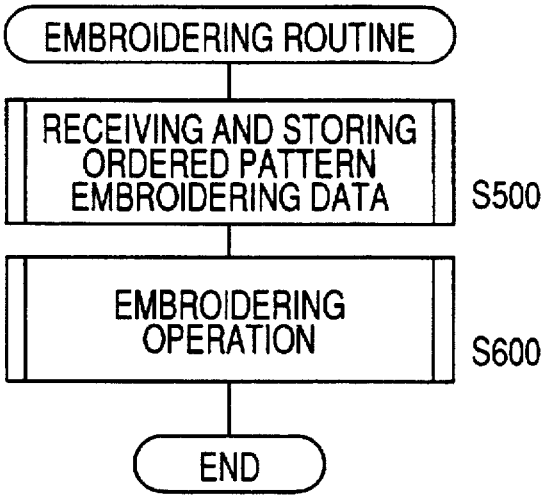
FIG. 3 is a flow chart illustrating an embroidering routine executed according to an embroidering control program stored in a ROM of a control device of a sewing section of the sewing machine.

The sewing portion 10 performs an embroidery sewing operation according to an embroidering routine illustrated in the flow chart of FIG. 3, on the basis of the received ordered pattern embroidering data. The embroidering routine of FIG. 3 is initiated with step S500 in which the received ordered pattern embroidering data are stored in the RAM 21. Step S500 is followed by step S600 in which the X-axis and Y-axis motors 32, 34 and the needle bar changing motor 40 are operated according to the ordered pattern embroidering data, to perform the embroidery sewing operation for embroidering the embroidery pattern on the work fabric.

Steps S100–S400 of the embroidering data processing routine of FIG. 4 will be described in detail.

In step S100, component data sets representative of desired pattern components designated by the operator through the keyboard 68 or mouse 70 are successively read out from the hard disk, such that the components represented by the designated component data sets are arranged in a row in a right direction, for example. In step S100, the operator then designates distances or intervals between the adjacent components. As a result, the computer 12 automatically determines the coordinate values of the reference points of the individual components of the embroidery pattern according to the relative position determining program, on the basis of the designated distances. That is, the operator need not enter the coordinate values of those reference points of the components. Thus, the computer 12 generates pattern embroidering data for embroidering the embroidery pattern wherein the operator's selected components are arranged with the operator's designated distances therebetween. The pattern embroidering data generated in step S100, which will be referred to as "non-ordered pattern embroidering data", are stored in the RAM 62. The component data sets of the non-ordered pattern embroidering data are stored in the RAM 62 in the order in which the components data sets were designated by the operator and successively read out from the hard disk. The components represented by the component data sets of the non-ordered pattern embroidering data are numbered in the above-indicated order, by respective component numbers M.

In the present specific example, the embroidery pattern consists of two or more components which are arranged in a row, each component consisting of two or more elements. In other words, the embroidery pattern is represented by and embroidered according to a batch of pattern embroidering data including two or more sets of components data representative of respective components, each set of component data consisting of two or more sets of element data representative of respective elements.

Each set of element data representative of an element of a component of an embroidery pattern includes thread designating data indicative of the kind of a thread used to embroider that element, and stitching data for moving the work holder 38 relative to the needle bar 36 to embroider the element. The sets of element data of the component are stored in relation to the sewing order in which the elements are embroidered. The elements of each component are numbered in the sewing order by respective element numbers N. The thread designating data consist of a thread code indicative of the property of the thread such as the color, thickness and luster. The thread code may be registered by the operator through the keyboard 68 or mouse 70, in relation to the properties of different threads.

Figure 8:
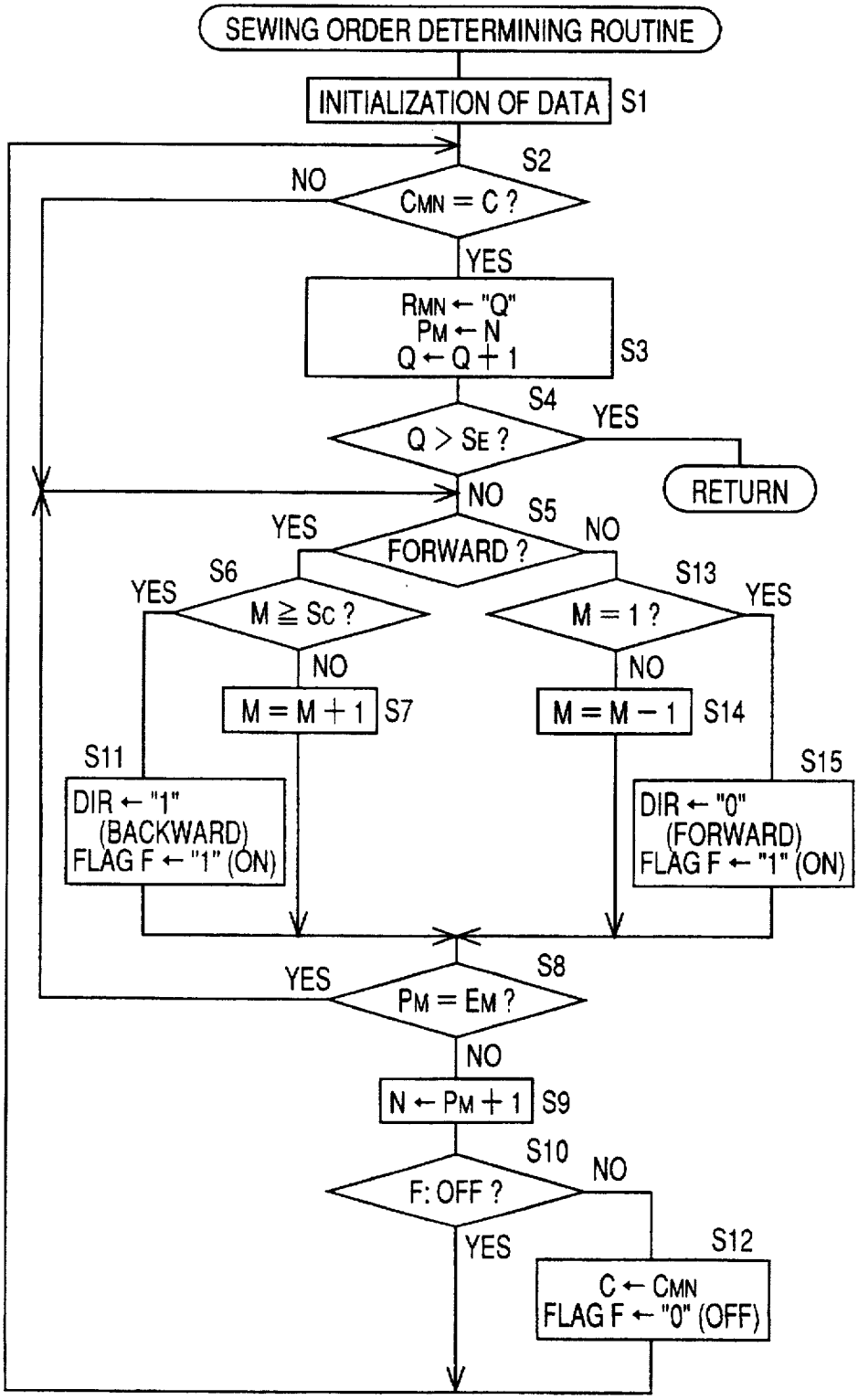
FIG. 8 is a flow chart illustrating a sewing order determining routine executed according to a sewing order determining program stored in the ROM of the embroidering data processing apparatus.

In step S200 of the embroidering data processing routine of FIG. 4, the non-ordered pattern embroidering data generated in step S100 are processed by a sewing order determining routine illustrated in the flow chart of FIG. 8, which is executed according to the above-indicated sewing order determining program. This routine of FIG. 8 is formulated to determine the order in which all of the elements of the embroidery pattern as represented by the non-ordered pattern embroidering data are embroidered.

Figure 6:
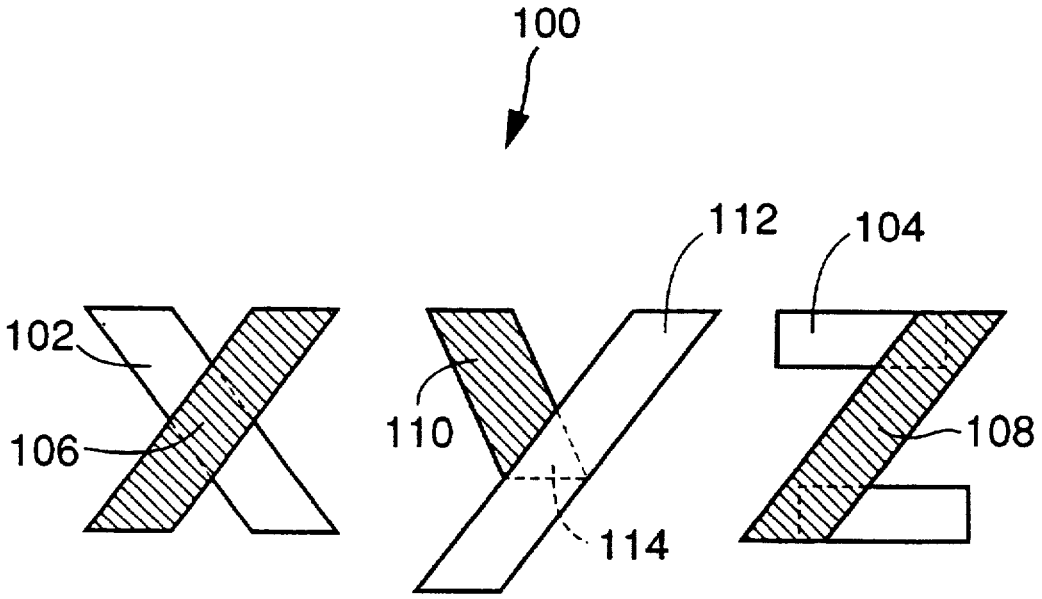
FIG. 6 is a view showing an embroidery pattern to be embroidered by the sewing section of the sewing machine.
Figure 14:
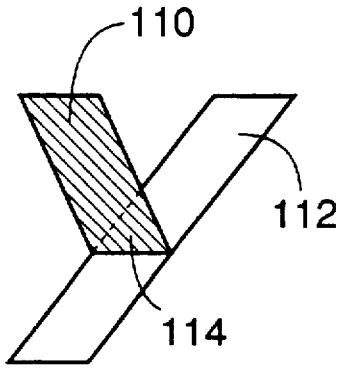
FIG. 14 is a view showing a component "y" of the embroidery pattern formed by embroidering according the pattern embroidering data processed by the conventional processing apparatus.

In the present embodiment, the sewing order determining routine of FIG. 8 is arranged to determine the sewing order of the elements of the embroidery pattern, for assuring intended reproduction of the original embroidery pattern, more specifically, for preventing the drawback which has been described above by reference to FIGS. 6 and 14 with respect to the overlapping portion 114 of the component "y", and for reducing the required number of thread changes. That is, the predetermined sewing order of the elements within each component is not changed according to the sewing order determining routine of FIG. 8, to prevent the color of the overlapping portion 114 of the embroidered adjacent elements 110, 112 from differing from the predetermined color (red). In other words, the sewing order of the elements in each component which are determined according to the routine of FIG. 8 is consistent with the predetermined sewing order as represented by the original component data set. Further, the sewing order is determined so that the required number of the thread changes is smaller according to ordered pattern embroidering data generated on the basis of the determination of the sewing order according to the present sewing order determining routine, than the required number of the thread changes according to the non-ordered pattern embroidering data. To this end, the sewing order of the elements is determined so as to maintain the order as represented by the predetermined element numbers N, namely, to embroider the element 110 before the element 112 as indicated in FIG. 6, rather than to embroider the element 112 before the element 110 as indicated in FIG. 14. Thus, the sewing order of the elements 110, 112 determined according to the present invention is consistent with the predetermined sewing order as represented by the element number N. Further, the sewing order is determined so that the elements for which the same thread is designated are continuously embroidered one after another, to an extent possible to meet the above requirement.

The sewing order determining routine of FIG. 8 is initiated with step S1 in which various data are initialized as indicated in the table of FIG. 9. Explained in detail, a total number $S_C$ of components and a total number $S_E$ of elements included in the embroidery pattern are entered, and a total number $E_M$ (M=1, 2, . . .) of elements included in each of the components is entered.

Further, order number codes $R_{MN}$ for all elements of the embroidery pattern are set to "0", and number $P_M$ of the "order-determined" elements in each component is set to "0". The order number code $R_{MN}$ given for each element identified by the component number M and the element number N indicates whether the determination of the sewing order number Q of that element is completed. The order number code $R_{MN}$ also represents the sewing order number Q given to the element in question. The order number code $R_{MN}$ other than "0" indicates that the sewing order number Q of the element has been determined. When the order number code $R_{MN}$ is set at "0", it indicates that the sewing order number Q of the element has not been determined. Since the sewing order numbers Q of any element of the embroidery pattern has not been determined upon initiation of the routine of FIG. 8, the order number codes $R_{MN}$ are set to "0" for all elements of the embroidery pattern, as indicated in the left column of the table of FIG. 9. The number $P_M$ is the number of the "order-determined" elements of each component (identified by the component number M), which elements have been given the sewing order numbers Q. The number $P_M$ is equal to the highest number N of the elements of the component whose sewing order numbers Q have been determined, namely, equal to the number N of the element whose sewing order number Q has been determined last. If the number $P_M$ of the "order-determined" elements of the component in question is equal to the to-al number $E_M$ of the elements included in that component, it means that the sewing order numbers Q of all the elements of the component have been determined. In this case, the order number codes $R_{MN}$ of all the elements included in that component in question are set at the given order numbers Q.

The component number M is the number of each component as counted in the direction in which the components of the embroidery pattern are arranged in a row, namely, as counted in the order in which the corresponding component data sets are stored in the RAM 62. The element number N is the number indicative of the predetermined sewing order of each of the elements within the component in question. All elements of all components of the embroidery pattern are identified by the component number M and the element number N. The initial values of the component number M and the element number N are "1", as indicated in the right column of the table of FIG. 9.

The color of each element identified by the component and element numbers M, N is represented by an element color code $C_{MN}$. The currently effective color is represented by a code C, which is initially set to "$C_{1\ 1}$" as indicated in the right column of the table of FIG. 9. In the specific example of the embroidery pattern of FIG. 6, the color of the first element 102 of the first component "x" is the initially selected color, which is represented by the element color code $C_{1\ 1}$. As described below, the sewing order determining routine of FIG. 8 is formulated to check whether the element color code $C_{MN}$ of each element is coincident with the currently effective color code C, and determine the sewing order number Q of the element if the color code $C_{MN}$ is coincident with the code C. The sewing order number Q is not determined if the element color code $C_{MN}$ is different from the code C. This checking of the element color codes $C_{MN}$ against the currently effective color code C will be referred to as "matching check" of the elements.

The currently effective color code C is updated when a COLOR CHANGING flag F is set to "1", but remains while the flag F is kept at "0". The COLOR CHANGING flag F and the currently effective color code C are changed when the direction in which the "matching check" of the elements is effected is changed. The matching check of the elements to determine whether the element color code $C_{MN}$ of each element is coincident with the currently effective color code C is effected in one of two directions, namely, a selected one of forward and backward directions. The forward direction is the direction in which the components of the embroidery pattern are arranged, that is, the direction corresponding to the order in which the components are arranged. When the matching check is effected in the forward direction, the element color codes $C_{MN}$ of the elements of the component whose number M is the smallest are checked first. When the matching check is effected in the backward direction opposite to the forward direction, the element color codes $C_{MN}$ of the elements of the component whose number M is the largest are checked first. The COLOR CHANGING flag F is kept at "0" as long as the matching check is effected in the same direction. When the direction of the matching check is changed from the forward direction to the backward direction or vice versa, the flag F is changed to "1". The flag F is initially reset to "0" as indicated in the right column of the table of FIG. 9.

A direction code DIR designates one of the forward and backward directions of the matching check. That is, the direction code DIR indicates the forward direction when it is set at "0", and the backward direction when it is set at "1". Initially, the direction code DIR is set to "0" to effect the matching check in the forward direction, as indicated in the right column of the table of FIG. 9. The sewing order number Q is initially set to "1" in step S1 so that the element whose sewing order Q is "1" is determined in step S2 and subsequent steps.

Referring back to the flow chart of FIG. 8, step S1 is followed by step S2 to effect the matching check of the element color code $C_{1\ 1}$ of the element identified by the component number 1 and the element number 1, namely, to determine whether the element color code $C_{1\ 1}$ is incident with the currently effective color code C, that is, the initially set color code $C=C_{1\ 1}$. When step S2 is implemented for the first time, an affirmative decision (YES) is obtained in step S2, and the control flow goes to step S3 to set the order number code $R_{1\ 1}$ to "1", that is, to give the currently set sewing order number Q (i.e., sewing order number "1") to the element identified by the component number N and the element number M. Further, the currently selected element number "1" is set as the number $P_1$, and the sewing order number Q is incremented to "2". The number P1 which is equal to "1" indicates that only one element is given the sewing order number Q.

Step S3 is followed by step S4 to determine whether the current sewing order number Q is larger than the total number $S_E$ of the elements of the embroidery pattern. When step S4 is implemented for the first time, a negative decision (NO) is obtained in step S4, and the control flow goes to step S5. When all of the elements of the embroidery pattern have been given the sewing order numbers Q in step S3, the sewing order number Q becomes larger by "1" than the total number $S_E$, and an affirmative decision (YES) is obtained in step S4, whereby the routine of FIG. 8 is terminated.

In the following steps S5–S9, S11 and S13–15, the component number M and the element number N of the element whose element color code $C_{MN}$ is subjected to the next matching check in step S2 are determined, as described below. That is, the element color code $C_{MN}$ of the element identified by the determined component and element numbers M, N is subject to the matching check in step S2, to determine whether the color code $C_{MN}$ is coincident with the currently set color code C. If the affirmative decision (YES) is obtained in step S2, the element identified by the component and element numbers M, N is given the currently set sewing order number Q. Namely, the given order number Q is stored as the order number code $R_{MN}$.

Step S5 is provided to determine whether the direction code DIR is set at "0" indicative of the forward direction. If an affirmative decision (YES) is obtained in step S5, the component number M is incremented in step S7 each time the matching check of the element color code $C_{MN}$ has been effected in step S2. If a negative decision (NO) is obtained in step S5, that is, if the direction code DIR is set at "1", the component number M is decremented in step S14. Since the direction code DIR is initially set at "0" (forward direction), the affirmative decision (YES) is obtained in step S5, and the control flow goes to step S6 to determined whether the current component number M is equal to or larger than the total number $S_C$ of the components of the embroidery pattern. When step S6 is implemented for the first time, the component number M is equal to "1", and a negative decision (NO) is obtained, so that step S7 is implemented to increment the component number M, namely, to change the current component number M=1 to "2". In this case, therefore, the element color code $C_{MN}$ of an element included in the component identified by the component number M=2 is subjected to the next matching check in step S2.

Step S7 is followed by step S8 to determine whether the number $P_M$ corresponding to the current component number M is equal to the total number $E_M$ of the elements of the component identified by the component number M. Since none of the elements of the component identified by the component number M=2 have been given the sewing order number Q, a negative decision (NO) is obtained in step S8, and the control flow goes to step S9. When all of the elements of the component number "1" have been given the sewing order numbers Q and the corresponding order number codes $R_{MN}$ have been accordingly set and stored, an affirmative decision (YES) is obtained in step S8, and the control flow goes back to step S5. In this case, the component number M is incremented in step S7.

Thus, step S7 is provided to determine or change the component number M indicative of the component including the element which is subjected to the next matching check in step S2. If all of the elements of the thus determined component have been given the sewing order numbers Q by the order number codes $R_{MN}$, that is, if the affirmative decision (YES) is obtained in step S8, the control flow does not go to step S2, but goes to step S7 to change the component number M. It will be understood that steps S7 and S8 correspond to means for designating the component of the embroidery pattern which is subjected to the next matching check of the element color code $C_{MN}$.

When the negative decision (NO) is obtained in step S8, that is, all of the elements of the component identified by the current component number M have not been given the sewing order numbers Q by the order number codes $R_{MN}$, step S9 is implemented to determine the element number N indicative of the element of the component in question, which element is subjected to the next matching check in step S2. The element number N determined in step S9 is equal to the number $P_M$ of the component number M plus "1". As explained above, the number $P_M$ is the number of the elements of the component which have already been given the sewing order numbers Q by the codes $R_{MN}$. The element number $N=P_M+1$ is the smallest number N of the element or elements whose sewing order number or numbers Q given by the code or codes $R_{MN}$ has/have not been determined. That is, the element number N is incremented in step S9. Since the element number indicative of the element to be subjected to the matching check is incremented in step S9 by one, the elements of the component in question are sequentially subjected to the matching check of the element color code $C_{MN}$, and are given the sewing order numbers Q by the codes $R_{MN}$, in the predetermined sewing order of the elements within the component. It will be understood that step S9 corresponds to means for designating the element which is subjected to the next matching check of the element color code.

When step S9 is implemented for the first time, the number $P_2$ of the component number M=2 is "0", the element number N is set to "1" in step S9. Then, the control flow goes to step S10 to determine whether the COLOR CHANGING flag F is set at "0" (OFF). Since the flag F is initially set to "0", an affirmative decision (YES) is obtained in step S10, and the control flow goes back to step s2.

In step S2, the element color code $C_{MN}$ of the element identified by the component and element numbers M, N which have been determined as described above is compared with the currently effective color code C. In this specific case where the component number M is "2" while the element number N is "1", the color code $C_{2\ 1}$ is compared with the color code C. If the color code $C_{2\ 1}$ is coincident with the color code C, step S2 is followed by step S3 in which the element identified by the component number M=2 and the element number N=1 is given the currently set sewing order number Q=2 with the code $R_{2\ 1}$ set at "2", and the number $P_M$ and the sewing order number Q are determined, as described above, so that the element color code $C_{3\ 1}$ of the element identified by the component number M=3 and the element number N=1 is subjected to the next matching check in step s2.

If the element color code $C_{2\ 1}$ is different from the currently effective color code C, a negative decision (NO) is obtained in step S2, the control flow goes to steps S5–S7 to increment the component number M to "3", skipping steps S3 and S4, that is, without incrementing the sewing order number Q. In this case, therefore, the element identified by the component number M=2 and the element number N=1 is not given the sewing order number Q with the code $R_{2\ 1}$ kept at "0", and the color code $C_{3\ 1}$ of the element identified by the component number M=3 and the element number N=1 is subjected to the next matching check in step s2.

As explained above, the element color codes $C_{MN}$ of the elements identified by the component and element numbers M, N are sequentially checked for coincidence with the currently effective color code C, to determine the sewing order numbers Q of the individual elements and set the codes $R_{MN}$ accordingly.

With steps S2–S10 repeatedly implemented, the component number M eventually reaches the total number $S_C$ of the components of the embroidery pattern, and an affirmative decision (YES) is obtained in step s6. In this case, the control flow goes to step S11 to set the direction code DIR to "1" indicative of the backward direction, and set the COLOR CHANGING flag F to "1" (ON). As a result of the setting of the flag F to "1", a negative decision (NO) is obtained in step S10, and the control flow goes to step S12 to change the currently effective color code C to the element color code $C_{MN}$ identified by the component and element numbers M, N, and set the flag to "0". Then, the control flow goes back to step S2.

In step S2, the element color code $C_{MN}$ of the element identified by the component number $M=S_C$ and the element number N is checked for coincidence with the currently effective color code C which has been updated in step S12. It will be understood that the affirmative decision (YES) is obtained in step S2 in this case, because the color code C set in step S12 is coincident with the color code $C_{MN}$. After steps S3 and S4 are implemented as described above, step S5 is implemented to determine whether the direction code DIR is set at "0". Since this code DIR has been set to "1" in step S11, a negative decision (NO) is obtained in step S5, and the control flow goes to step S13 to determine whether the component number M is equal to "1". Since the current component number M is equal to the total number $S_C$ of the components of the embroidery pattern, a negative decision (NO) is obtained in step S13, and the control flow goes to step S14 to decrement the component number M. Then, steps S8–S10 will be implemented as described above. Thus, steps S2–S5, S13, S14 and S8–S10 are repeatedly implemented as the component number M is decremented in step S14.

When the component number M has been decremented to "1", an affirmative decision (YES) is obtained in step S13, and the control flow goes to step S15 to set the direction code DIR to "0" indicative of the forward direction, and set the flag F to "1". As a result, the negative decision (NO) is obtained in step S10, and the currently effective color code C is changed to the color code $C_{1_N}$ identified by the component number M=1 and the element number $N=P_1+1$.

It will be understood from the foregoing explanation that the elements of each component of the embroidery pattern are given the respective sewing order numbers Q by the codes $R_{MN}$, by sequential matching check of the element color codes $C_{MN}$ of the elements identified by the component and element numbers M, N, while the component number M is incremented from "1" to the total number $S_C$ of the components, and is then decremented from "$S_C$" to "1". That is, the matching check of the element color codes $C_{MN}$ is effected alternately in the forward and backward directions. The currently effective color code C is changed when the direction of the matching check is reversed or changed from the forward direction to the backward direction and vice versa.

Since the direction of the matching check of the element color code $C_{MN}$ is alternately changed between the forward and backward directions, the matching check in the present embodiment may be referred to as "bidirectional matching check".

Thus, the present sewing order determining routine of FIG. 8 is formulated to determine the sewing order numbers Q (set the order number codes $R_{MN}$) of the elements of the embroidery pattern by the matching check of the element color codes $C_{MN}$ effected alternately in the forward and backward directions. When an embroidery sewing operation is performed according to ordered pattern embroidering data obtained on the basis of the thus set order number codes $R_{MN}$, the number of comparatively long jumping stitches between the components is made smaller than when the sewing operation is performed according to ordered pattern embroidering data obtained on the basis of the determination of the sewing order numbers is effected by the sewing order numbers Q determined (order number codes $R_{MN}$ set) by the matching check in one direction. The reduced number of the long jumping stitches results in reduced wasting of the threads, and improved sewing efficiency.

When all of the elements in the embroidery pattern have been given the sewing order numbers Q by the codes $R_{MN}$, an affirmative decision (YES) is obtained in step S4, and the routine of FIG. 8 is terminated.

Figure 7:
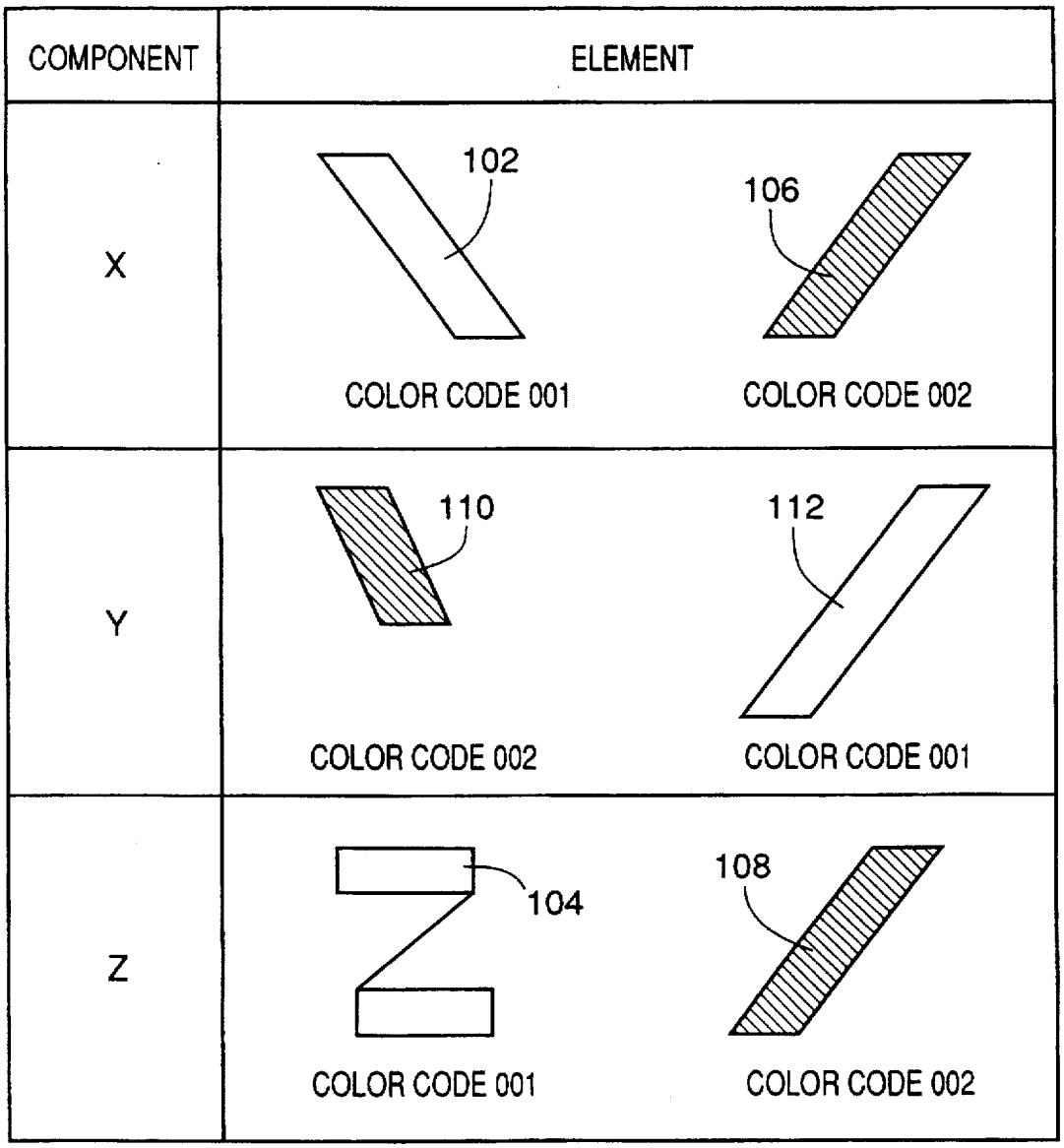
FIG. 7 is a view showing components of the embroidery pattern of FIG. 6, and elements of each of the components.

Referring to FIGS. 6 and 7, the determination of the sewing order numbers of the elements of the embroidery pattern 100 will be described by way of example, for clarifying the concept of the present invention.

Initially, the component data sets representative of the components "x", "y" and "z" are designated by the machine operator in this order of description, and are retrieved from the hard disk. Then, the distances or intervals between the adjacent components "x", "1", "y" and "z" are designated by the operator. As a result, the coordinate values of the reference points of the components are automatically determined. Thus, the retrieved and processed component data sets representative of the components "x", "y" and "z" are stored in the RAM 62 in relation to the component numbers M, as non-ordered pattern embroidering data.

Figure 10:
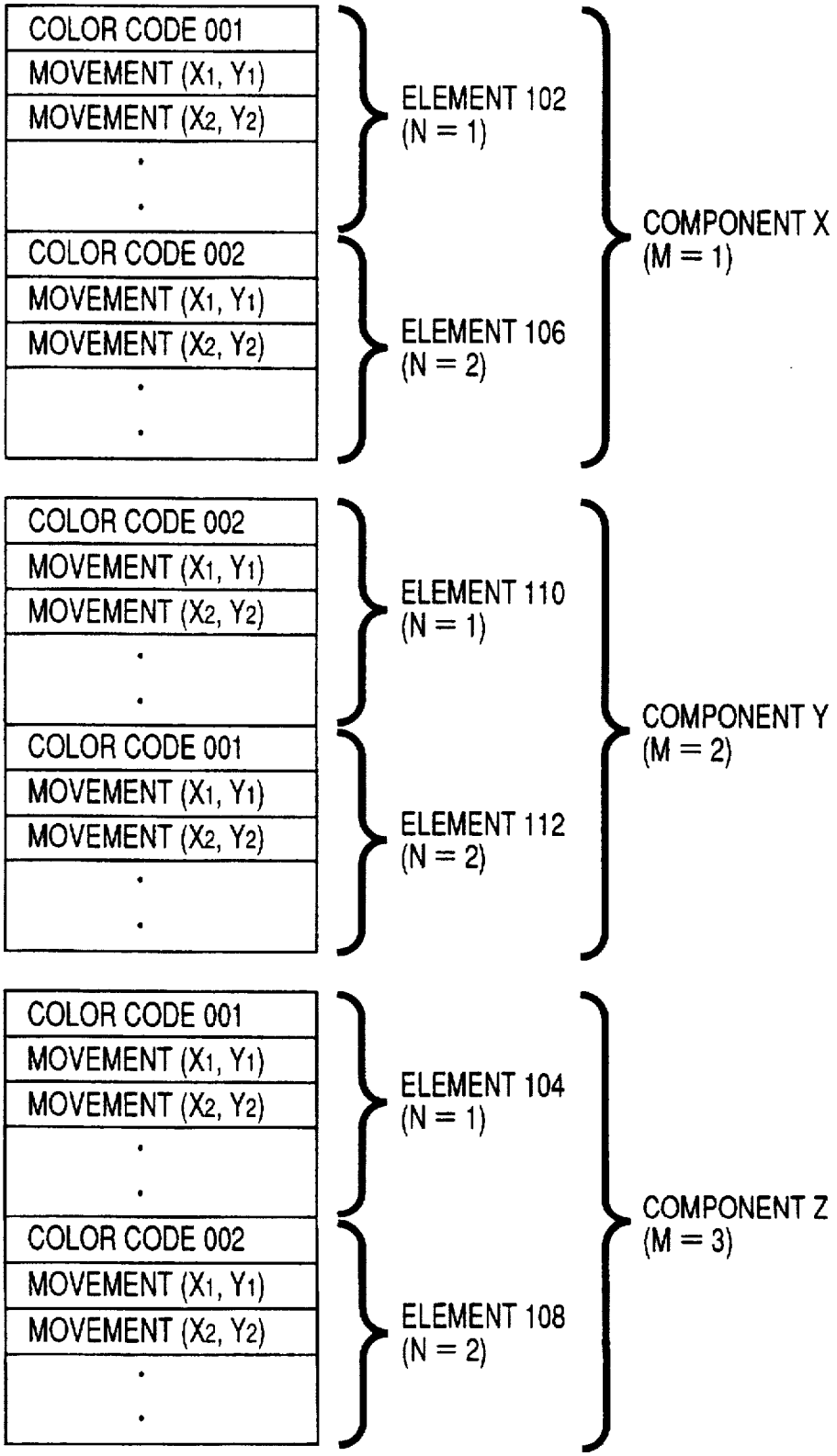
FIG. 10 is a view illustrating embroidering data stored in a RAM of the embroidering data processing apparatus.

As indicated in FIGS. 6 and 7, the component "x" consists of the elements 102 and 106 which are represented by respective element data sets. As indicated in FIG. 10, the element data set representative of the element 102 includes a thread color code in the form of an element color code 001 indicative of the thread color, and stitching data in the form of relative movement data (stitch position data) representative of the amounts of movements of the work holder 38 relative to the needle (selected needle bar 36). The element data set for the element 102 is stored in relation to the element number N=1 (predetermined sewing order number 1 within the component "x"). The element data set representative of the element 106 includes an element color code 002 and relative position data (stitching data), and is stored in relation to the element number N=2. The component data set of the component "x" consisting of the element data sets for the elements 102, 106 is stored in relation to the component number M=1. In the present embodiment, the color code 001 designates the thread having a red color, while the color code 002 designates the thread having a blue color.

The component "y" consists of the elements 110 and 112 which are represented by respective element data sets. The element data set representative of the element 110 includes an element color code 002, and relative movement data (stitch position data), and is stored in relation to the element number N=1. The element data set representative of the element 112 includes an element color code 001 and relative position data (stitch position data), and is stored in relation to the element number N=2. The component data set of the component "y" consisting of the element data sets for the elements 110, 112 is stored in relation to the component number M=2.

The component "z" consists of the elements 104 and 108 which are represented by respective element data sets. The element data set representative of the element 104 includes an element color code 001, and relative movement data (stitch position data), and is stored in relation to the element number N=1. The element data set representative of the element 108 includes an element color code 002 and relative position data (stitch position data), and is stored in relation to the element number N=2. The component data set of the component "z" consisting of the element data sets for the elements 104, 108 is stored in relation to the component number M=3.

In the sewing order determining routine of FIG. 8 according to the present embodiment, the sewing order numbers of the elements 102, 104, 106, 108, 110, 112 of the embroidery pattern 100 are determined so as to maintain the predetermined order of the elements of each component as represented by the element numbers N, and so as to maximize the number of the elements which are continuously embroidered by the same thread (by the thread having the same color).

In the initialization step S1, the total component number $S_C$ and the total element number $S_E$ are set to "3" and "6", respectively, and the total element number $E_M$ of each component "x", "y", "z" is set to "2". The component "x" at the left end of the embroidery pattern 100 is given the component number M=1, and the components "y" and "z" are given the component numbers M=2, 3, respectively. Further, the currently effective color code C is set to "$C_{1\ 1}$"=001 indicative of the thread color.

In step S2, the element color code $C_{1\ 1}$ of the element 102 identified by the component number M=1 and the element number N=1 is checked for coincidence with the currently effective color code C=001. When step S2 is implemented for the first time, the affirmative decision (YES) is obtained in step S2, and step S3 is implemented to set the order number code $R_{1\ 1}$ of the element 102 to "1" indicating that the sewing order number "1" has been given to the element 102. That is, the sewing order number Q=1 is given to the element 102. The number $P_1$ of the component "x" and the sewing order number Q are set to "1" and "2", respectively, also in step S3. Then, steps S4–S10 are implemented to set the component number M and the element number N to "2" and "1", respectively, so that the color code $C_{2\ 1}$ ("002") of the element 110 of the component "y" is checked for coincidence with the currently effective color code C=001, in the next implementation of step s2. In this case where the element color code $C_{2\ 1}$ ("002") is different from the currently effective color code C=001, the negative decision (NO) is obtained in step S2, and the control flow goes to steps S6 and S7, skipping steps S3 and S4, whereby the sewing order number Q remains to be "2", and the component number M is incremented to "3". Thus, no sewing order number Q is given to the element 110 of the component "y".

In the next implementation of step S2, the element color code $C_{3\ 1}$ ("001") of the element 104 of the component "z" is checked for coincidence with the currently effective color code C=001. In this case, the affirmative decision (YES) is obtained in step S2, and step S3 is implemented so that the sewing order number Q=2 is given to the element 104 with the code $R_{3\ 1}$ set to "2", and the number $P_3$ of the component "z" and the sewing order number Q are set to "1" and "3", respectively.

Since the current component number M=3 is equal to the total number $S_C$=3 of the components of the embroidery pattern, the affirmative decision (YES) is obtained in step S6, and the control flow goes to step S11 to set the direction code DIR to "1" (indicative of the backward direct-on) and set the flag F to "1" (indicative of a need to change the currently effective color code C). Consequently, the element number N is incremented to "2" in step S9, and the negative decision (NO) is obtained in step S10, so that step S12 is implemented to change the currently effective color code C from $C_{1\ 1}$ to $C_{3\ 2}$ of the element 108 of the component "z", and reset the flag F to "0" (OFF).

In the next implementation of step S2, the element color code $C_{3\ 2}$ of the element 108 is checked for coincidence with the currently effective color code C=$C_{3\ 2}$. Since the affirmative decision (YES) is obtained in step S2 in this case, the currently set sewing order number Q=3 is given to the element 108 with the code $R_{3\ 2}$ set to "3". Since the direction code DIR is currently set at "1" indicative of the backward direction of the matching check, the negative decision (NO) is obtained in step S5, so that the component number M is decremented from "3" to "2". In the next implementation of step S2, therefore, the element color code $C_{2\ 1}$ of the element 110 of the component "y" is checked for coincidence with the currently effective color code C=002. Since the element color code $C_{2\ 1}$ is "002", the affirmative decision (YES) is obtained in step S2, and the sewing order number Q=4 is given to the element 110 in step S3 with the code $R_{2\ 1}$ set to "4". In this connection, it is noted that the element 110 which is given the sewing order number Q=4 is embroidered before the element 112 whose sewing order number Q has not been given yet.

Then, the component number M is decremented to "1" in step S14, and the element number N is incremented to "2" in step S9. In the next implementation of step S2, therefore, the element color code $C_{1\ 2}$ of the element 106 of the component "x" is checked for coincidence with the currently effective color code C=002. The affirmative decision (YES) is obtained in step S2, and the currently set sewing order number Q=5 is given to the element 106 of the component "x", with the code $R_{1\ 2}$ set to "5".

Since the component number M is equal to "1", the affirmative decision (YES) is obtained in step S13, and the control flow goes to step S15 to set the direction code DIR to "0" indicative of the forward matching check direction, and set the flag F to "1". Since the number $P_1$ of the elements of the component "x" which have already been given the sewing order numbers Q is equal to "2" (=$E_1$), the affirmative decision (YES) is obtained in step S8, the control flow goes back to step S5 to determine whether the direction code DIR is set at "0".

Since the direction code DIR is currently set at "0", the affirmative decision (YES) is obtained in step S5, and step S7 is implemented to increment the component number M from "1" to "2". Since the number $P_2$ of the component "y" is still "1", the negative decision (NO) is obtained in step S8, and step S9 is implemented to increment the element number N to "2". In the next step S10, the negative decision (NO) is obtained since the flag F has been set to "1" in step S15. Consequently, the control flow goes to step S12 to change the currently effective color code C from $C_{3\ 2}$ to $C_{2\ 2}$ ("001"), and reset the flag F to "0".

In the next implementation of step S2, the element color code $C_{2\ 2}$ of the element 112 of the component "y" is checked for coincidence with the currently effective color code C=001. Since the affirmative decision (YES) is obtained in step S2, the currently set sewing order number Q=6 is given to the element 112 of the component "x" in step S3, with the code $R_{2\ 2}$ set to "6". Therefore, the element 112 of the component "y" is embroidered after the element 110.

Since the sewing order number Q is incremented to "7" in step S3, this number Q becomes larger than the total number $S_E$=6 of the elements of the embroidery pattern 100 and the affirmative decision (YES) is obtained in step S4, whereby the routine of FIG. 8 is terminated.

As described above, the embroidering order of the elements 102–112 of the embroidery pattern 10 is determined according to the sewing order determining routine of FIG. 8 so that the elements 102, 104, 108, 110, 106 and 112 are embroidered in this order of description, with the red color thread used for the elements 102, 104 and 112 and with the blue color thread used for the elements 108, 110, 106. In the component "x" , the element 102 for which the red color is designated is embroidered before the element 106 for which the blue color is designated. In the component "y", the element 110 for which the blue color is designated is embroidered before the element 112 for which the red color is designated. Thus, the sewing order of the elements 110, 112 of the component "y" is different from the sewing order of the elements 102, 106 of the component "x", in terms of the colors of the threads. However, the sewing order number Q=1 given to the element 102 of the component "x" by the code $R_{1\ 1}$ is smaller than the sewing order number Q=5 given to the element 106 of the same component "x" by the code $R_{1\ 2}$, like the element number N=1 of the element 102 is smaller than the element number N=2 of the element 106. Similarly, the sewing order number Q=4 given to the element 110 of the component "y" by the code $R_{2\ 1}$ is smaller than the sewing order number Q=6 of the element 112 of the same component "y" by the code $R_{2\ 2}$, like the element number N=1 of the element 110 is smaller than the element number N=2 of the element 112.

After the sewing order of the elements of the embroidery pattern is determined in step S200 of the embroidering data processing routine of FIG. 4, according to the sewing order determining routine of FIG. 8, the control flow goes to step S300 of the routine of FIG. 4 in which the ordered pattern embroidering data are generated on the basis of the non-ordered embroidery data and the determined sewing order of the elements. Described more specifically, the element data sets representative of the elements of the embroidery pattern are arranged as indicated in FIG. 11, in the determined sewing order, namely, according to the sewing order numbers Q given to the individual elements 102, 104, 106, 108, 110, 112 by the code $R_{MN}$. The ordered pattern embroidering data include sets of feed data representative of the amounts of feeding movements between the components, which correspond to respective jumping stitches. The amounts of the feeding movements correspond to the lengths of the jumping stitches. For instance, a jumping stitch is formed between the stitching end point of the element 102 of the component "x" and the stitching start point of the element 104 of the component "z". The ordered pattern embroidering data further include sets of color change command data for changing the color of the thread used, that is, for changing the thread.

In the next step S400, the ordered pattern embroidering data generated in step S300 are stored in the floppy disk 76 and the hard disk, and are transmitted to the sewing portion 10 through the communication interface (I/F) 50 and cable 14.

In the sewing portion 10, the embroidering routine illustrated in the flow chart of FIG. 3 is executed. In step S500 of this routine, the ordered pattern embroidering data are received by the communication interface (I/F) 48. Step S500 is followed by step S600 in which the X-axis and Y-axis drive motors 32, 34 and the needle bar changing motor 40 are controlled through the respective driver circuits, according to the received ordered pattern embroidering data, so as to form the embroidery pattern 100, for instance. The floppy disk 76 is one form of a recording medium of the present invention for storing the ordered pattern embroidering data which are formulated to embroider the elements of the embroidery pattern in the suitable sewing order determined according to the sewing order determining routine of FIG. 8 which has been described in detail.

In the specific example of FIG. 6 wherein the embroidery pattern 100 is embroidered according to the ordered pattern embroidering data obtained according to the sewing order determining routine of FIG. 8, the overlapping portion 116 of the elements 102, 106 of the embroidered component "x" has the blue color as designated by the element color code $C_{1\ 2}$, and the overlapping portion 114 of the elements 110, 112 of the embroidered component "y" has the red color as designated by the element color code $C_{2\ 1}$. Therefore, the present arrangement is capable of preventing the drawback as illustrated in FIG. 14, that is, the drawback that the overlapping portion 114 has the blue color contrary to the element color code $C_{2\ 2}$=001 indicative of the red color. See the table of FIG. 9.

It is also noted that the red thread is first used for the elements 102 and 104, the blue thread is then used for the elements 108, 110, 106, and the red thread is again used for the element 112 which is embroidered last. Therefore, the required number of thread changes according to the present arrangement is "2", and is smaller than the required number ("3") of thread changes according to the arrangement in which the elements 102, 106 of the component "x" are embroidered prior to the elements 110, 112 of the component "y", which are embroidered prior to the elements 104, 108 of the component "z". If a larger number of such embroidery patterns as shown in FIG. 6 are embroidered, the time required for changing the threads is considerably reduced, and the embroidering efficiency is accordingly improved. Since only two colors are designated by the element color codes for all of the elements 102, 104, 106, 108, 110, 112 of the embroidery pattern 100, the embroidering operation of this embroidery pattern 100 can be effected by a single thread change. To avoid the drawback of FIG. 14 (namely, to embroider the blue element 110 prior to the red element 112) according to the principle of the invention, there are two thread changes (two changes of the thread colors).

It is also noted that the ordered pattern embroidering data are stored in the floppy disk 76, which may be used for an embroidery sewing machine equipped with the personal computer 12 functioning as the embroidering data processing apparatus, as long as the sewing machine is capable of reading and utilizing the ordered pattern embroidering data.

Further, the embroidering data processing program including the sewing order determining program as illustrated in the flow chart of FIG. 8 are stored in the floppy disk 78 as well as the ROM 61. This floppy disk 78 may be used on an ordinary personal computer. The floppy disk 78 and the ROM 61 constitute a recording medium storing the ordered pattern embroidering data.

It will be understood that the RAM 62 of the control portion 64 and the hard disk incorporated in the personal computer 12 constitute a major portion of embroidering data memory for storing a plurality of component data sets for embroidering components of an embroidery pattern. This embroidery data memory includes thread designating data memory for storing thread designating data indicative of the kind of a thread used for embroidering each component of the embroidery pattern. Further, the portion of the control portion 64 assigned to store and execute the sewing order determining program for the routine of FIG. 8 constitutes a major portion of the sewing order determining program for determining the sewing order numbers of the individual elements of the embroidery pattern. This sewing order determining program includes a matchings check program for determining whether an element color code for each element of the embroidery pattern is coincident with a currently effective color code, and giving a currently set sewing order number to that element if the element color code is coincident with the currently effective color code. The sewing order determining program further includes a check control program for changing the direction of the matching check of the elements, and changing the kind of the thread upon changing of the direction of the the matching check. Described in detail, the portion of the control portion 64 assigned to implement steps S2–S9, S13 and S14 of FIG. 8 constitutes the matching check program, while the portion of the control portion 64 assigned to implement steps S10-S12 an S15 constitutes the check control program. In the present embodiment, the sewing order determining program determines the sewing order numbers of the elements so as to minimize the number of changes of the threads, and further determines the sewing order numbers of the elements on the basis of the thread designating data stored in the thread designating data memory.

It will further be understood that the portion of the control portion 64 assigned to implement steps S1–S7 and S10–S12 constitutes the thread change reducing program for reducing the required number of changes of the thread colors, and that the portion of the control portion 64 assigned to implement steps S8 and S9 constitutes the sewing order coordinating program for coordinating the sewing order of the elements while permitting the thread change reducing program to reduce the number of changes of the thread colors.

It is also noted that the hard disk incorporated in the personal computer 12 also functions as component data memory for storing the component data sets representative of commonly or frequently used components of embroidery patterns, and that the hard disk drive 72, keyboard 68, mouse 70 and control portion 64 constitute selective retrieval apparatus for selectively retrieving the component data sets from the component data memory. Further, the floppy disk drive 74 constitutes a portion of embroidering data memory, and the control portion 64, communication interface 50 and cable 14 constitute a major portion of embroidering data supplying apparatus for supplying the embroidering data to an embroidery sewing machine.

In the illustrated embodiment, the sewing order numbers of the elements of the embroidery pattern are determined so as to assure intended reproduction of the embroidery pattern, more specifically, to assure that the sewing order of the elements of each component determined according to the present invention is consistent with the predetermined sewing order of the elements as represented by the original component data set, and to reduce the number of the thread changes. However, the sewing order numbers of the elements may be determined so as to satisfy at least one condition or requirement, which includes at least one of: preventing a change of the determined sewing order from the predetermined sewing order as indicated above; preventing jumping or bridging stitches having a length larger than a predetermined threshold; and preventing two successive sewing order numbers of the elements which belong to respective different components which are spaced apart from each other by two or more other components interposed therebetween, where the components are arranged in a row. When at least one of the last two conditions is satisfied, the length of the jumping stitches may be reduced, and the required total length of the threads may be reduced.

While the stitching data used in the illustrated embodiment take the form of relative position data or stitch position data representative of the amounts of relative movements between the work holder 38 and the needle bar 36, the stitching data may take other forms such as element outline data and thread density data. The element outline data represent the outline of each element of an embroidery pattern. The element outline data may include mathematical equations representative of the outlines of the elements, and vector data representative of individual segments of the outlines. Where an element consists of a plurality of local blocks or areas, an element data set representative of an element includes sets of block data representative of the respective blocks of the element.

Figure 12:
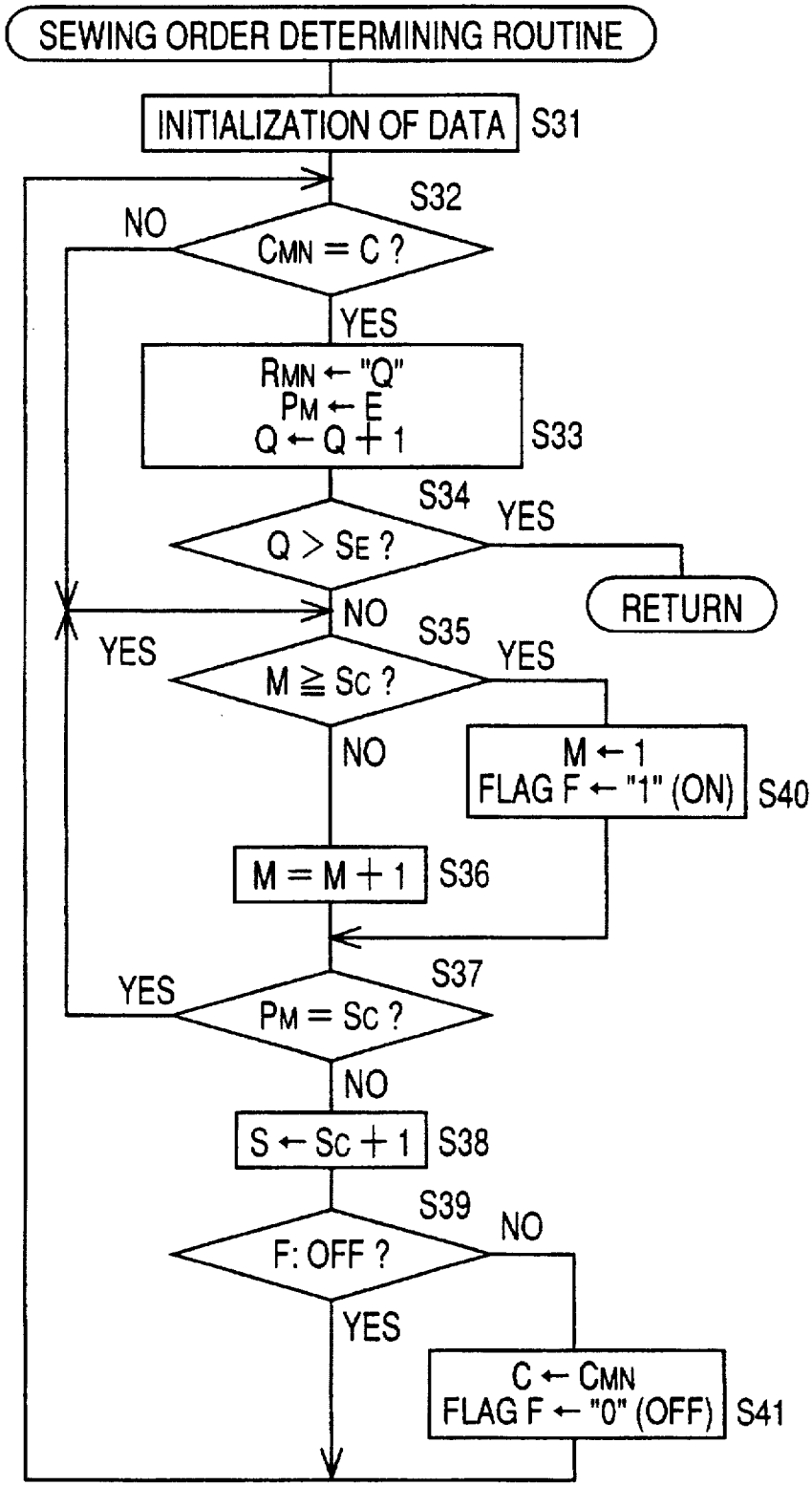
FIG. 12 is a flow chart illustrating a sewing order determining routine according to another embodiment of this invention.
Figure 13:
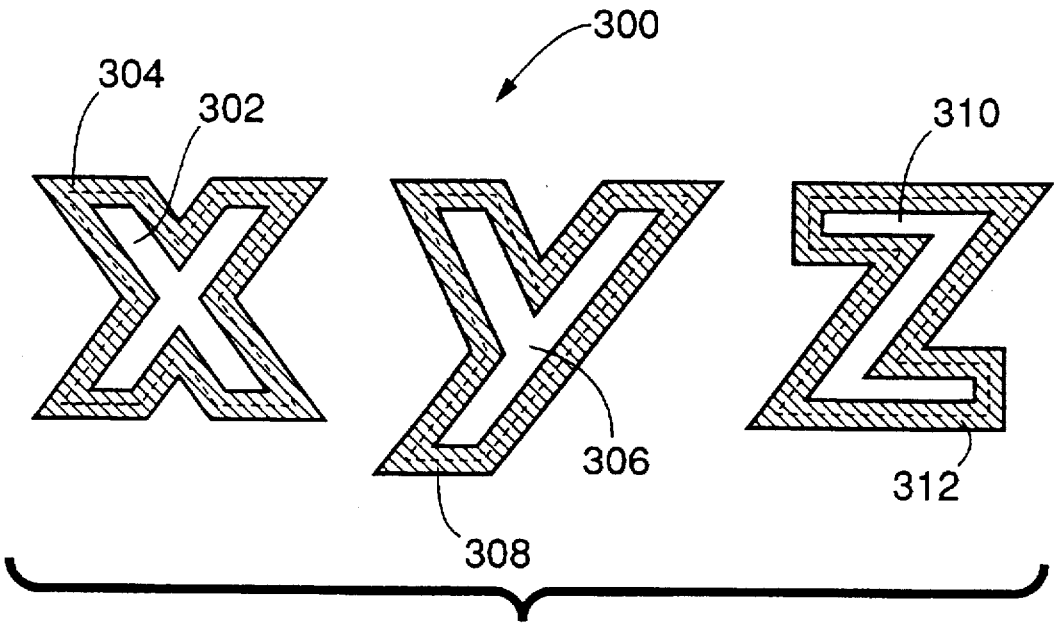
FIG. 13 is a view showing an embroidery pattern formed according to pattern embroidering data processed by a conventional embroidering data processing apparatus.

The sewing order determining program or routine illustrated in the flow chart of FIG. 8 may be replaced by other programs or routines such as a sewing order determining routine illustrated in the flow chart of FIG. 12. This routine does not use the direction code DIR indicative of the forward or backward direction of the matching check of the color codes $C_{MN}$, and is therefore formulated to effect the matching check of the elements in the forward direction in which the components of the embroidery pattern are arranged in the order of the component numbers M. The routine of FIG. 12 includes step S36 to increment the component number M, and step S35 to determine whether the component number M has been increased to the total number $S_C$ of the components. If an affirmative decision (YES) is obtained in step S35, the control flow goes to step S40 to reset the component number M to the initial value "1" and set the COLOR CHANGING flag F to "1". When the flag F is set to "1", the appropriate element of the component identified by the component number M=1 is subjected to the next matching check of the color code. Thus, the matching check of the color codes of the elements is always effected in the forward direction, and the flag F also functions to change the currently effective color code C when the matching check returns to the component number 1.

In the present second embodiment of FIG. 12, the elements 102, 104, 106, 110, 108 and 112 are given the respective sewing order numbers Q which increase in this order and the red thread is designated for the elements 102 and 104, the blue thread is then designated for the elements 106, 110 and 108, and the red thread is again designated for the last embroidered element 112. Therefore, the present arrangement requires two thread changes (two thread color changes).

The second embodiment may be modified so that the matching check of the color codes of the elements is always effected in the backward direction opposite to the forward direction in which the components are arranged in the order of the component numbers M.

The embroidery pattern whose data are processed according to the present invention is not limited to an embroidery pattern as shown as 100 in FIGS. 6 and 7. For instance, the embroidery pattern may consist of three or more components, or a single component. Further, the color code may represent three or more colors selectively used for the individual elements of the embroidery pattern. The embroidering data including the pattern embroidering data may include thread designating data indicative of the thickness or luster of the thread.

Although the components "x", "y" and "z" of the embroidery pattern 100 are arranged in a substantially straight row, the components may be otherwise arranged. In this case, the coordinate values of the leftmost uppermost position, for example, of each component are designated by the operator to position the components relative to each other. In the illustrated embodiment, the relative position determining program is used to automatically position the components relative to each other in a substantially straight row, after the distances or intervals between the adjacent components are designated by the operator. However, this relative position determining program is not essential even where the components are arranged in a substantially straight row, since the operator may designate the positions of the components, as described above.

In the example of the embroidery pattern 100, the element 104 consists of two separate enclosed areas. However, these separate enclosed areas may be treated as separate elements. Namely, every element may consist of a single enclosed area.

Commonly used component data sets such those representative of characters "a" through "z" and "A" through "Z" may be stored in a floppy disk. In this case, the desired component data sets are retrieved from the floppy disk through the floppy disk drive 74, by operator's manipulation of the keyboard 68 or mouse 70.

Although the personal computer 12 is connected to the sewing section 10 through the cable 14, data communication between the computer 12 and the sewing section 10 may be achieved otherwise, for instance, by optical data communication While both the keyboard 68 and the mouse 70 are provided in the illustrated embodiments, either one of these inputs devices may be provided. Further, other data input devices such as an input device equipped with a digitizer tablet may be used.

Although the work holder 38 provided in the sewing section 10 is movable in the X-axis and Y-axis direction, the sewing section may be arranged such that the needle bar 36 (or needle bar support casing 44) may be moved in the X-axis and Y-axis directions relative to a stationary work holder.

The sewing machine may consist of the sewing section 10 and a floppy disk drive adapted to accept the floppy disk 76 which stores the ordered pattern embroidering data obtained according to the sewing order determining program by a suitable embroidering data processing apparatus (similar to the personal computer 12). In this case, the sewing section 10 is operated to perform an embroidering operation according to the ordered pattern embroidering data retrieved from the floppy disk 76.

It is to be understood that the present invention may be embodied with various other changes, modifications and improvements, which may occur to those skilled in the art, without departing from the spirit and scope of the invention defined in the following claims.

What is claimed is:

1. An embroidering data processing apparatus comprising:

embroidering data memory means for storing embroidering data for embroidering an embroidery pattern, said embroidering data including a batch of pattern embroidering data which include a plurality of component data sets for embroidering respective components of said embroidery pattern, each of said components consisting of at least one element each of which is continuously embroidered by a same thread, said embroidering data memory means storing said component data sets in a predetermined storing order; and sewing order determining means for determining a sewing order in which all of said elements included in said embroidery pattern are sequentially embroidered;

said sewing order determining means determining sewing order numbers of said elements of said embroidery pattern, so as to satisfy at least one predetermined condition, and such that the number of changes of threads required for embroidering said elements according to said sewing order numbers is smaller than that required for embroidering said elements of said components in said predetermined storing order.

2. An embroidering data processing apparatus according to claim 1, wherein said sewing order determining means includes determining means for determining said sewing order numbers of said elements so as to minimize said number of changes of threads.

3. An embroidering data processing apparatus according to claim 1, further comprising component data memory means for storing a plurality of component data sets representative of components, and selective retrieval means for selectively retrieving from said component data memory means a plurality of said component data sets and storing the retrieved component data sets in said embroidering data memory means in said predetermined storing order.

4. An embroidering data processing apparatus according to claim 1, wherein said pattern embroidering data stored in said embroidering data memory means as original pattern embroidering data are processed into ordered pattern embroidering data which are formulated to embroider said elements of said embroidery pattern according to said sewing order numbers determined by said sewing order determining means, said apparatus further comprising a recording device for recording said ordered pattern embroidering data in a removably installed recording medium.

5. An embroidering data processing apparatus according to claim 1, wherein said pattern embroidering data stored in said embroidering data memory means as original pattern embroidering data are processed into ordered pattern embroidering data which are formulated to embroider said elements of said embroidery pattern according to said sewing order numbers determined by said sewing order determining means, said apparatus further comprising embroidering data supplying means for supplying said ordered pattern embroidering data to an embroidery sewing machine.

6. An embroidering data processing apparatus according to claim 1, wherein said embroidering data memory means includes thread designating data memory means for storing thread designating data indicative of a kind of a thread used for embroidering each of said elements, and said sewing order determining means includes determining means for determining said sewing order numbers of said elements on the basis of said thread designating data stored in said thread designating data memory means.

7. An embroidering data processing apparatus according to claim 6, wherein said thread designating data include color designating data indicative of a color of the thread.

8. An embroidering data processing apparatus according to claim 1, further comprising relative position determining means for determining relative positions of said components of said embroidery pattern.

9. An embroidering data processing apparatus according to claim 1, wherein said components of said embroidery pattern are arranged in a row, and said embroidering data storing means stores said component data sets in said predetermined storing order which corresponds to an order in which said components are arranged in said row, and wherein said sewing order determining means comprises:

thread designating means for sequentially designating a plurality of threads of different kinds in a predetermined order;

matching check means for effecting a matching check to determine whether each one of said at least one element of each of said components should be embroidered by the thread currently designated by said thread designating means and whether said each one element satisfies said at least one predetermined condition if said each one element is given a currently set sewing order number, said matching check means giving said currently set sewing order number to said each one element if an affirmative determination is obtained by said matching check; and check control means for alternately changing a direction of said matching check of said elements of said embroidery pattern between a forward direction corresponding to said predetermined storing order and a backward direction opposite to said forward direction, said check control means commanding said thread designating means for changing the currently designated thread to the next one when said direction of the matching check is changed.

10. An embroidering data processing apparatus according to claim 1, wherein each of said plurality of component data sets of said embroidery pattern consists of a plurality of element data sets for embroidering a plurality of elements, respectively, and said embroidering data memory means stores said plurality of element data sets of said each component data set such that said element data sets are stored in a state which is indicative of a predetermined sewing order of said plurality of elements within said each component, and wherein said at least one predetermined condition includes a condition that said sewing order numbers of said elements of said each component which are determined by said sewing order determining means are consistent with said predetermined sewing order.

11. An embroidering data processing apparatus according to claim 10, wherein said components of said embroidery pattern are arranged in a row, and said embroidering data storing means stores said plurality of component data sets in said predetermined storing order which corresponds to an order in which said components are arranged in said row, and wherein said embroidering data memory means includes thread designating data memory means for storing thread designating data indicative of a kind of a thread used for embroidering each of said elements, said sewing order determining means comprising:

thread designating means for sequentially designating a plurality of threads of different kinds in a predetermined order;

matching check means for effecting a matching check to determine whether the kind of the thread designated by said thread designating data for each one of said plurality of elements within said each component is coincident with the kind of the thread currently designated by said thread designating means, said matching check means giving a currently set sewing order number to said each one element if an affirmative determination is obtained by said matching check and if the sewing order number of said each one element has not been determined, said matching check of said plurality of elements within said each component being effected in said predetermined sewing order of said elements within said each component; and check control means for alternately changing a direction of said matching check of said elements of said embroidery pattern between a forward direction corresponding to said predetermined storing order and a backward direction opposite to said forward direction, said check control means commanding said thread designating means for changing the currently designated thread to the next one when said direction of the matching check is changed.

12. An embroidering data processing apparatus according to claim 1, wherein each of said plurality of component data sets consists of at least one element data set for embroidering said at least one element, respectively, each of said at least one element data set including outline data defining an outline of the element.

13. An embroidering data processing apparatus according to claim 1, wherein each of said plurality of component data sets consists of at least one element data set for embroidering said at least one element, respectively, each of said at least one element data set including stitch position data representative of positions at which stitches are formed by the thread.

14. An embroidering data processing apparatus comprising:

selecting means for selecting desired component data sets from among a plurality of component data sets for embroidering respective components each of which consists of at least one element each of which is continuously embroidered by a same thread, said desired component data sets being used to embroider a desired embroidery pattern, said plurality of component data sets including at least one color changing data set each being indicative of a change of color of the thread;

thread change reducing means for processing said desired component data sets selected by said selecting means, such that the number of changes of color of the thread required for embroidering said embroidery pattern according to the processed desired component data sets is smaller than that required for embroidering said embroidery pattern according to said desired component data sets as selected by said selecting means; and sewing order coordinating means for coordinating a sewing order of the elements of the components represented by said selected desired component data sets, so as to avoid a drawback which would take place if said elements were embroidered according to said component data sets as processed by said thread change reducing means to reduce the number of said changes of color of the thread.

15. An embroidering data processing apparatus according to claim 14, wherein said thread change reducing means includes means for minimizing the number of said changes of color of the thread.

16. An embroidering data processing apparatus according to claim 14, wherein each of said plurality of component data sets consists of at least one element data set for embroidering said at least one element, respectively, each of said at least one element data set including outline data defining an outline of the element.

17. An embroidering data processing apparatus according to claim 14, wherein each of said plurality of component data sets consists of at least one element data set for embroidering said at least one element, respectively, each of said at least one element data set including stitch position data representative of positions at which stitches are formed by the thread.

18. A method of processing embroidering data including a batch of pattern embroidering data for embroidering an embroidery pattern, said batch of pattern embroidering data including a plurality of component data sets for embroidering respective components each of which consists of at least one element each of which is continuously embroidered by a same thread, said method comprising:

storing said batch of pattern embroidering data in embroidering data memory means such that said plurality of component data sets are stored in a predetermined storing order; and determining a sewing order in which all of the elements included in said embroidery pattern are sequentially embroidered, so as to satisfy at least one predetermined condition, and such that the number of changes of threads required for embroidering said elements in the determined sewing order is smaller than that required for embroidering said elements of said components in said predetermined storing order.

19. A method according to claim 18, wherein each of said plurality of component data sets of said embroidery pattern consists of a plurality of element data sets for embroidering a plurality of elements, respectively, said each component data set being formulated such that said plurality of elements within said each component are embroidered in a predetermined order, and wherein said at least one predetermined condition includes a condition that the determined sewing order of said plurality of elements of said each component is consistent with said predetermined order.

20. A recording medium storing a sewing order determining program for processing embroidering data for embroidering an embroidery pattern, said embroidering data including a batch of pattern embroidering data which include a plurality of component data sets for embroidering respective components of said embroidery pattern, each of said components consisting of at least one element each of which is continuously embroidered by a same thread, said sewing order determining program being formulated to determine a sewing order in which all of said elements included in said embroidering pattern are sequentially embroidered, so as to satisfy at least one predetermined condition, and such that the number of changes of threads required for embroidering said elements in said sewing order determined according to said sewing order determining program is smaller than that required for embroidering said embroidery pattern such that said components are sequentially embroidered in a predetermined order.

21. A recording medium according to claim 20, wherein said components of said embroidery pattern are arranged in a row, and said sewing order determining program is formulated to determine said sewing order such that the number of said changes of threads required for embroidering said elements according to the determined sewing order is smaller than that required for embroidering said components in an order in which said components are arranged.

22. A recording medium storing embroidering data for embroidering an embroidery pattern consisting of a plurality of components each of which consists of at least one element each of which is continuously embroidered by a same thread, said plurality of components including at least two components each of which includes at least two elements that should be embroidered by respective different threads, said embroidering data being formulated such that a sewing order in which all of the elements included in said embroidery pattern are embroidered is determined such that a sewing order of said at least two elements of one of said at least two components is different from a sewing order of said at least two elements of another of said at least two components, and such that the number of changes of the threads required for embroidering said embroidery pattern in the determined sewing order is smaller than that required for embroidering said embroidery pattern such that said plurality of components are sequentially embroidered in a predetermined order.

23. An embroidery sewing machine comprising:

a stitching device for forming stitches on a workpiece;

a positioning device for positioning said workpiece and said stitching device relative to each other in a plane parallel to a plane of said workpiece; and a control device for controlling said stitching device and said positioning device;

and wherein said control device comprises embroidering data supplying means for supplying said stitching device with embroidering data including ordered pattern embroidering data for embroidering an embroidery pattern consisting of a plurality of components each of which consists of at least one element each of which is continuously embroidered by a same thread, said plurality of components including at least two components each of which includes at least two elements that should be embroidered by respective different threads;

said ordered pattern embroidering data of said embroidering data supplied from said control device being formulated such that a sewing order in which all of the elements included in said embroidery pattern are embroidered is determined such that a sewing order of said at least two elements of one of said at least two components is different from a sewing order of said at least two elements of another of said at least two components, and such that the number of changes of the threads required for embroidering said embroidery pattern in the determined sewing order is smaller than that required for embroidering said embroidery pattern such that said plurality of components are sequentially embroidered in a predetermined order.

24. An embroidery sewing machine according to claim 23, wherein said control device includes a device for retrieving said embroidering data from a removably installed recording medium.

25. An embroidery sewing machine according to claim 23, wherein said control device includes embroidering data processing apparatus comprising:

embroidering data memory means for storing non-ordered pattern embroidering data consisting of a plurality of component data sets representative of said plurality of components of said embroidery pattern, said said embroidering data memory means storing said component data sets in a predetermined storing order; and sewing order determining means for determining said sewing order in which all of said elements included in said embroidery pattern are sequentially embroidered;

said sewing order determining means determining sewing order numbers of said elements of said embroidery pattern, so as to satisfy at least one predetermined condition, and such that the number of changes of threads required for embroidering said elements according to said sewing order numbers is smaller than that required for embroidering said elements of said components in said predetermined storing order, said ordered pattern embroidering data being obtained on the basis of said non-ordered pattern embroidering data stored in said embroidering data memory means and said sewing order numbers determined by said sewing order determining means.

26. An embroidery sewing machine according to claim 23, wherein said ordered pattern embroidering data include relative position data representative of amounts of relative movements of said stitching device and said workpiece, said embroidering data supplying means comprising means for supplying said relative position data to said positioning device.

* * * * *